US011365628B1

(12) United States Patent
Cox

(10) Patent No.: US 11,365,628 B1
(45) Date of Patent: Jun. 21, 2022

(54) MATERIAL-REMOVAL SYSTEMS, CUTTING TOOLS THEREFOR, AND RELATED METHODS

(71) Applicant: US Synthetic Corporation, Orem, UT (US)

(72) Inventor: Edwin Sean Cox, Spanish Fork, UT (US)

(73) Assignee: US Synthetic Corporation, Orem, UT (US)

( * ) Notice: Subject to any disclaimer, the term of this patent is extended or adjusted under 35 U.S.C. 154(b) by 0 days.

(21) Appl. No.: 17/034,257

(22) Filed: Sep. 28, 2020

Related U.S. Application Data

(63) Continuation of application No. 16/552,747, filed on Aug. 27, 2019, now Pat. No. 10,822,947, which is a continuation of application No. 15/065,258, filed on Mar. 9, 2016, now Pat. No. 10,436,029.

(60) Provisional application No. 62/181,070, filed on Jun. 17, 2015, provisional application No. 62/135,037, filed on Mar. 18, 2015.

(51) Int. Cl.

| | |
|---|---|
| ***E21C 35/183*** | (2006.01) |
| ***E21C 35/19*** | (2006.01) |
| ***E21C 25/18*** | (2006.01) |
| *B02C 18/18* | (2006.01) |

(52) U.S. Cl.
CPC ..... *E21C 35/183* (2013.01); *E21C 25/18* (2013.01); *E21C 35/1833* (2020.05); *E21C 35/1837* (2020.05); *E21C 35/19* (2013.01); *B02C 18/18* (2013.01)

(58) Field of Classification Search
CPC ..... E21C 35/183; E21C 35/1831; E21C 35/1833; E21C 35/1835; E21C 35/1837
USPC ..... 299/113
See application file for complete search history.

(56) References Cited

U.S. PATENT DOCUMENTS

| | | | |
|---|---|---|---|
| 4,268,089 | A | 5/1981 | Spence et al. |
| 4,327,120 | A | 4/1982 | Siemers et al. |
| 5,582,353 | A | 12/1996 | Willibald |
| 7,469,852 | B2 | 12/2008 | Sharp |
| 7,866,418 | B2 | 1/2011 | Bertagnolli et al. |
| 7,998,573 | B2 | 8/2011 | Qian et al. |
| 8,034,136 | B2 | 10/2011 | Sani |
| 8,236,074 | B1 | 8/2012 | Bertagnolli et al. |
| 10,436,029 | B1 | 10/2019 | Cox |

(Continued)

FOREIGN PATENT DOCUMENTS

| | | | |
|---|---|---|---|
| DE | 4327120 | C1 | 8/1993 |
| FR | 2605676 | A1 * | 4/1988 |
| WO | 9505273 | A1 | 2/1995 |

OTHER PUBLICATIONS

Machine Translation of French document 6 pages (Year: 1988).*

(Continued)

*Primary Examiner* — Sunil Singh
(74) *Attorney, Agent, or Firm* — Phillips Winchester

(57) ABSTRACT

Embodiments described herein relate to material-removal systems as well as cutting tools and cutting tool assemblies that may be used in the material-removal systems. More specifically, for example, the material-removal systems, and particularly the cutting tools, may engage and fail target material. In some instances, the material-removal systems may be used in mining operations.

18 Claims, 12 Drawing Sheets

(56) References Cited

U.S. PATENT DOCUMENTS

2014/0327294 A1 11/2014 Johnson et al.
2015/0314483 A1* 11/2015 Miess ..... E01C 23/127
299/104

OTHER PUBLICATIONS

Issue Notification for U.S. Appl. No. 16/552,747 dated Oct. 14, 2020.
Advisory Action for U.S. Appl. No. 15/065,258 dated Dec. 31, 2018.
Final Office Action for U.S. Appl. No. 15/065,258 dated Oct. 25, 2018.
Issue Notification for U.S. Appl. No. 15/065,258 dated Sep. 18, 2019.
Non-Final Office Action for U.S. Appl. No. 15/065,258 dated Feb. 4, 2019.
Non-Final Office Action for U.S. Appl. No. 15/065,258 dated Jun. 15, 2018.
Notice of Allowance for U.S. Appl. No. 15/065,258 dated May 30, 2019.
Notice of Allowance for U.S. Appl. No. 16/552,747 dated Jun. 29, 2020.
Restriction Requirement for U.S. Appl. No. 15/065,258 dated Mar. 5, 2018.
Restriction Requirement for U.S. Appl. No. 16/552,747, dated Oct. 17, 2019.
U.S. Appl. No. 13/027,954, filed Feb. 15, 2011.
U.S. Appl. No. 13/100,388, filed May 4, 2011.
U.S. Appl. No. 13/275,372, filed Oct. 18, 2011.
U.S. Appl. No. 15/065,258, filed Mar. 9, 2016.
U.S. Appl. No. 16/552,747, filed Aug. 27, 2019.
U.S. Appl. No. 62/135,037, filed Mar. 18, 2015.
U.S. Appl. No. 62/181,070, filed Jun. 17, 2015.

* cited by examiner

MATERIAL-REMOVAL SYSTEMS, CUTTING TOOLS THEREFOR, AND RELATED METHODS

CROSS-REFERENCE TO RELATED APPLICATIONS

This application is a continuation of U.S. application Ser. No. 16/552,747 filed on 27 Aug. 2019, which is a continuation of U.S. application Ser. No. 15/065,258 filed on 9 Mar. 2016, which claims priority to U.S. Provisional Application No. 62/135,037 filed on 18 Mar. 2015 and U.S. Provisional Application No. 62/181,070 filed on 17 Jun. 2015, the disclosure of each of the foregoing applications is incorporated herein, in its entirety, by this reference.

BACKGROUND

Material-removal systems, such as mining machines, commonly use cutting tools or picks that engage and cut into target material. For example, cutting tools may be mounted on a rotatable mining head of a mining machine. While the mining head rotates, the mining machine and/or a mining head thereof may be advanced toward and into the target material. Hence, the cutting tools may engage, cut, or otherwise fail the target material as the mining head advances into the target material. Subsequently, the failed target material may be recovered or removed from its location, such as from a mine.

Particular target material may vary from one mining application to another. For example, mining machines may be used to fail and recover Trona or similar minerals and materials. In any event, operation of the mining machines typically results in wear of the cutting tools, which may lead to reduced useful life and reduced productivity as well as failure thereof, among other things.

Therefore, manufacturers and users continue to seek improved cutting tools and material-removal systems to extend the useful life thereof.

SUMMARY

Embodiments described herein relate to cutting tools and cutting tool assemblies, as well as related material-removal systems that may include and/or use the cutting tools and cutting tool assemblies. For example, the material-removal systems and, particularly, the cutting tools thereof, may engage and fail target material. The failed target material may be subsequently removed. In some instances, the removed material may be sent for further processing (e.g., the removed material may be a mined material, such as Trona). Alternatively, the removed material may be generally a waste material (e.g., the material-removal system may be a tunnel boring machine ("TBM"), which may form a tunnel during operation thereof). In any event, the cutting tools and cutting tool assemblies described herein may be used in any number of suitable machines and operations, including TBMs, earth pressure balance machines ("EPBs"), raise drilling systems, large diameter blind drilling systems, and other types of mechanical drilling and excavation systems.

An embodiment includes a cutting tool assembly. The cutting tool assembly includes a base body and one or more cutting tools secured to the base body. The base body includes a surface mountable to a cutterhead of a material-removal machine. The base body also includes one or more tool positioning features. Each of the one or more cutting tools includes a tool body, one or more cutting elements secured to the tool body and extending outward therefrom, and a positioning feature adjacent to a corresponding one of the one or more tool positioning features. The positioning feature and the one or more tool positioning features are sized and configured to position and orient the tool body. Furthermore, each of the cutting elements includes a superhard table defining a working surface.

At least one embodiment includes a material-removal system. The material removal system includes a movable and/or rotatable cutterhead and one or more cutting tool assemblies mounted to the movable and/or rotatable cutterhead. Each of the one or more cutting tool assemblies includes a base body and one or more cutting tools secured to the base body. The base body includes one or more tool positioning features. Each of the one or more cutting tools includes a positioning feature interfaced with a corresponding one of the one or more tool positioning features. The positioning feature of each of the one or more cutting tools positioning and/or orienting the tool body on the base body. Also, each of the one or more cutting tools includes one or more cutting elements each of which includes a superhard table defining a working surface.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments, wherein identical reference numerals refer to identical or similar elements or features in different views or embodiments shown in the drawings.

DETAILED DESCRIPTION

Figure 1A:
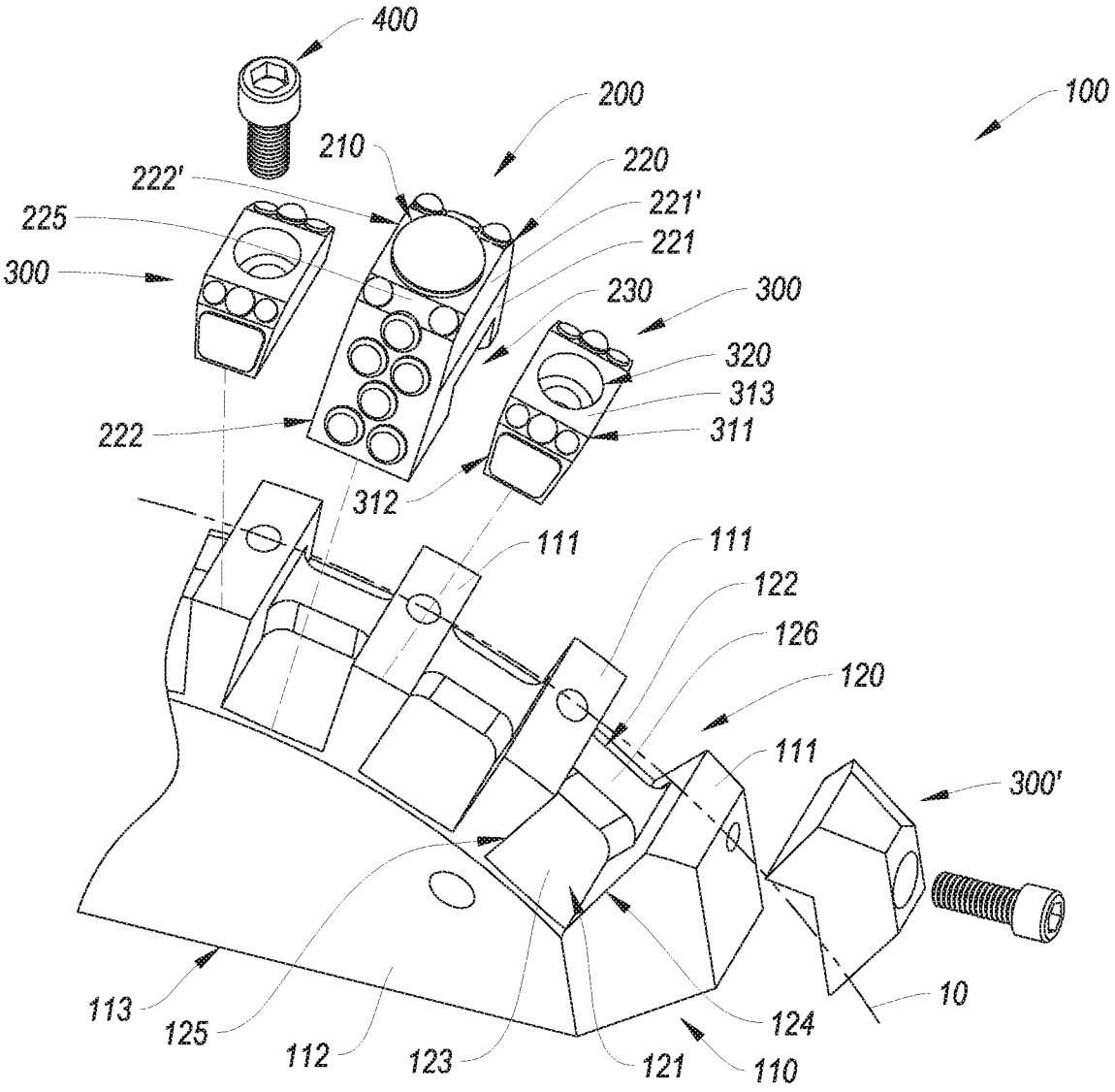
FIG. 1A is a partial, isometric, exploded view of a cutting tool assembly according to an embodiment.

Embodiments described herein relate to cutting tools and cutting tool assemblies, as well as related material-removal systems that may include and/or use the cutting tools and cutting tool assemblies. For example, the material-removal systems and, particularly, the cutting tools thereof, may engage and fail target material. The failed target material may be subsequently removed. In some instances, the removed material may be sent for further processing (e.g., the removed material may be a mined material, such as Trona). Alternatively, the removed material may be generally a waste material (e.g., the material-removal system may be a TBM, which may form a tunnel during operation thereof). In any event, the cutting tools and cutting tool assemblies described herein may be used in any number of suitable machines and operations, including TBMs, EPBs, raise drilling systems, large diameter blind drilling systems, and other types of mechanical drilling and excavation systems.

Generally, the material-removal systems disclosed herein may include a movable cutterhead, and the cutting assembly may be mounted on or secured to the cutterhead (FIG. 12). In some embodiments, the cutterhead may rotate, drag, drill, or scrape relative to the target material and may be advanced toward and/or into the target material, thereby engaging one or more cutting tools and/or cutting tool assemblies with target material and failing the target material. For example, the cutterhead may have a generally linear movement (e.g., such that advancement of the cutterhead into and/or relative to the target material drags the cutting assemblies and/or cutting tools linearly relative to and in contact with a face of the target material).

In some embodiments, the cutting tool assembly may be mounted or secured to the cutterhead of the material-removal system and may be positioned and oriented in a manner to engage and fail the target material during operation of the material-removal system. The cutting tool assembly may include a base body and one or more cutting tools mounted or secured to the base body. For example, the cutting tools may be removably secured to the base body. According to at least one embodiment, the cutting tools may be removably secured to the base body. More specifically, for example, one, some, or all of the cutting tools may be removed and may be replaced with new and/or different tools.

Under some operating conditions, cutting tools that were damaged, worn out, or otherwise rendered suitable for replacement during operation or cutting may be replaced with new and/or different tools (e.g., reconditioned cutting tools). In some embodiments, cutting tools mounted or secured to the base body may be replaced with different cutting tools, which may be more suitable for engaging a particular target material. For example, cutting tools and/or cutting tool assemblies may be replaced when the assembly includes cutting tools for hard target material, such as granite, and the material-removal system engages or is intended to engage softer material, such as target material composed of clay and rocks, consolidated sand, soil, silt, etc., or vice versa.

Furthermore, in at least one embodiment, the cutting tools may be removed from the base body and replaced without removing the base body from the cutterhead of the material-removal system. For example, one, some, or all of the cutting tools secured to the base body may be fastened thereto with one or more fasteners, brazing clamps, combinations thereof, or other fastening mechanisms that may facilitate selectively securing the cutting tools to the base body. Hence, to remove and/or replace the cutting tools, the fasteners, clamps, etc., may be loosened, melted, and/or removed, thereby allowing removal of the cutting tools from the base body. Moreover, replacement cutting tools may be secured to the base body by reconnecting (e.g., the fasteners, clamps, etc.) or rebrazing.

Figure 1B:
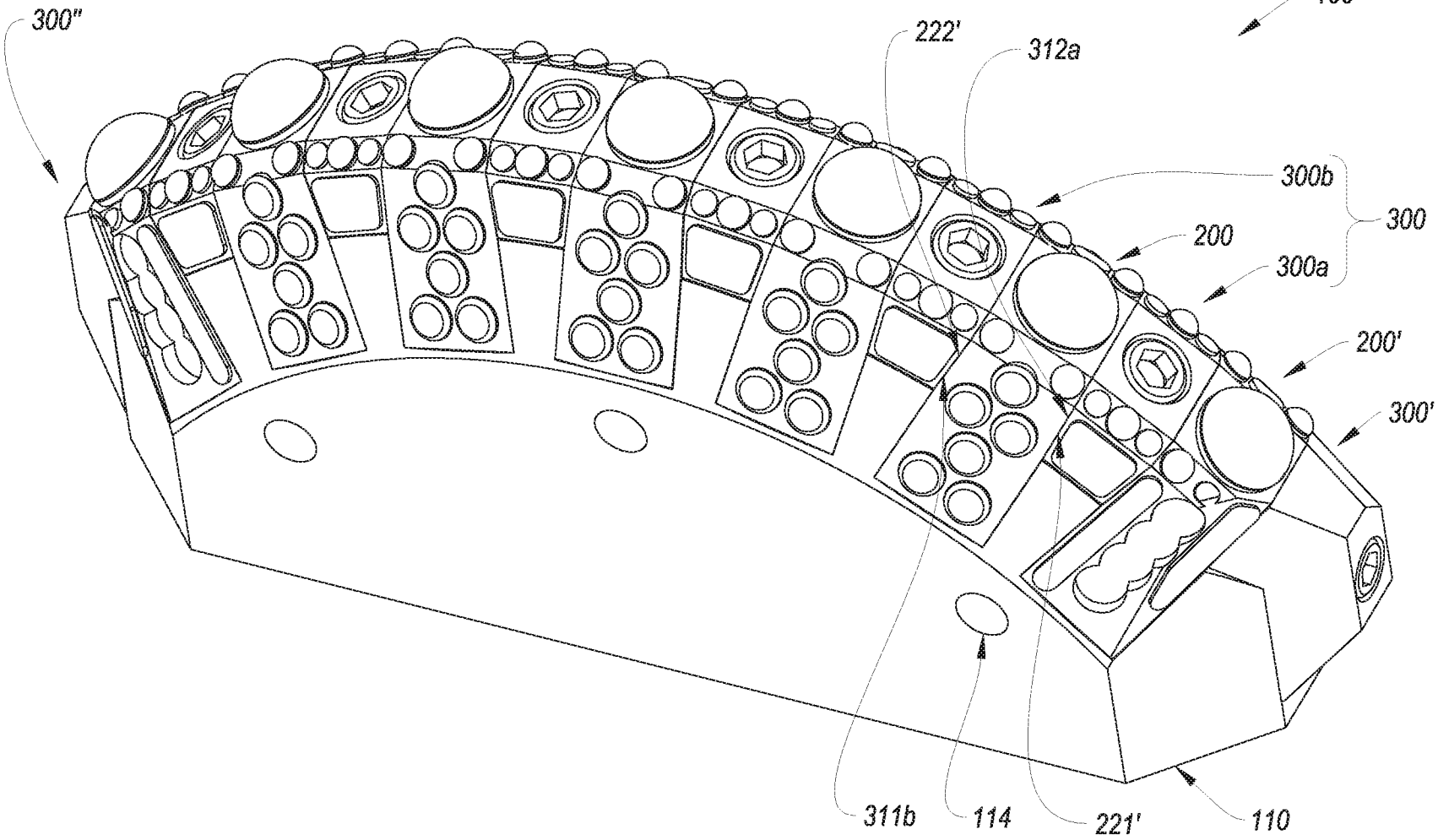
FIG. 1B is an isometric view of an assembled cutting tool assembly of FIG. 1A.

FIG. 1A is an exploded, isometric view of a cutting tool assembly 100 according to an embodiment and FIG. 1B is an isometric view of the cutting tool assembly 100 of FIG. 1A assembled. The cutting tool assembly 100 may include a base body 110 and one or more cutting tools 200 (not all shown) secured to the base body 110. Generally, the base body 110 may secure any number of cutting tools 200, which may vary from one embodiment to the next. The cutting tools 200 may have any number of suitable arrangements on the base body 110. For example, the cutting tools 200 may be positioned on the base body 110 along a generally curved path (e.g., along a curved reference line 10). Additionally or alternatively, one or more of the cutting tools 200 may be positioned or secured to the base body 110 along a generally straight or linear path. In any event, the cutting tools 200 may be secured to the base body 110 in a manner that facilitates engagement of the cutting tools 200 with the target material during operation of the material-removal system, as described below in more detail.

Each of the cutting tools 200 may include one or more cutting elements 210 (not all labeled) mounted and/or secured to a cutting tool body 220. For example, after mounting and securing the cutting tools 200 to the base body 110, the cutting elements 210 may be positioned and/or oriented in a manner that facilitates engagement thereof with the target material (e.g., when the cutting tool assembly 100 is mounted and or secured to a cutterhead (e.g., the cutterhead shown FIG. 12 or other suitable cutterhead) of the material-removal system). Moreover, in some embodiments, after the cutting tools 200 are mounted and/or secured to the base body 110, the cutting elements 210 may collectively form or define one or more cutting edges or work surfaces (e.g., an interrupted or serrated cutting edge(s) or work surface(s)) of the cutting tool assembly 100. In some embodiments, when mounted and/or secured to the base body, the cutting tools 200 may define a rake angle along which failed material may move away from the cutting edge(s) and/or work surface(s) of the cutting tool assembly 100 (e.g., the rake angle may be on the front face of the cutting tool assembly).

The cutting tools 200 may include any number of cutting elements 210 mounted or secured thereto. Moreover, the cutting elements 210 may have any number of suitable sizes, shapes, configurations, or combinations of the foregoing, which may vary from one embodiment to the next. In some embodiments, one, some, or all of the cutting elements 210 may include superhard or superabrasive material (e.g., having hardness at least as high as tungsten carbide, such as polycrystalline diamond), as described below in more detail.

The base body 110 may have any suitable shape and/or size. In some embodiments, at least one side of the base body 110 may be shaped to follow a general path along which the cutting tools 200 are positioned. For example, upper surfaces 111 (not all labeled) of the base body 110 may generally follow and may be offset from the curved reference line 10 (e.g., the upper surfaces 111 may lie along a generally arcuate line or surface). In some embodiments, one, some, or all of the upper surfaces 111 may be generally planar and/or may be angled relative to the adjacent surfaces such that the upper surfaces 111 collectively generally follow the curved reference line 10.

In at least one embodiment, the base body 110 may have one or more mounting and/or orientation surfaces, which may facilitate positioning and/or orienting the base body 110 (and the cutting tool assembly 100) on a cutterhead of the material-removal system. For example, the mounting and/or orientation surfaces may facilitate positioning and/or orienting the base body 110 and the cutting tool assembly 100 relative to a front face of a cutterhead. Moreover, the mounting and orientation surfaces of the base body 110 may facilitate positioning and/or orienting the cutting tools 200 on a cutterhead (e.g., relative to the front face of a cutterhead 510, as shown in FIG. 13), such as to form collective cutting edge(s) and/or working surface(s) defined by the cutting elements 210, as mentioned above.

Figure 13:
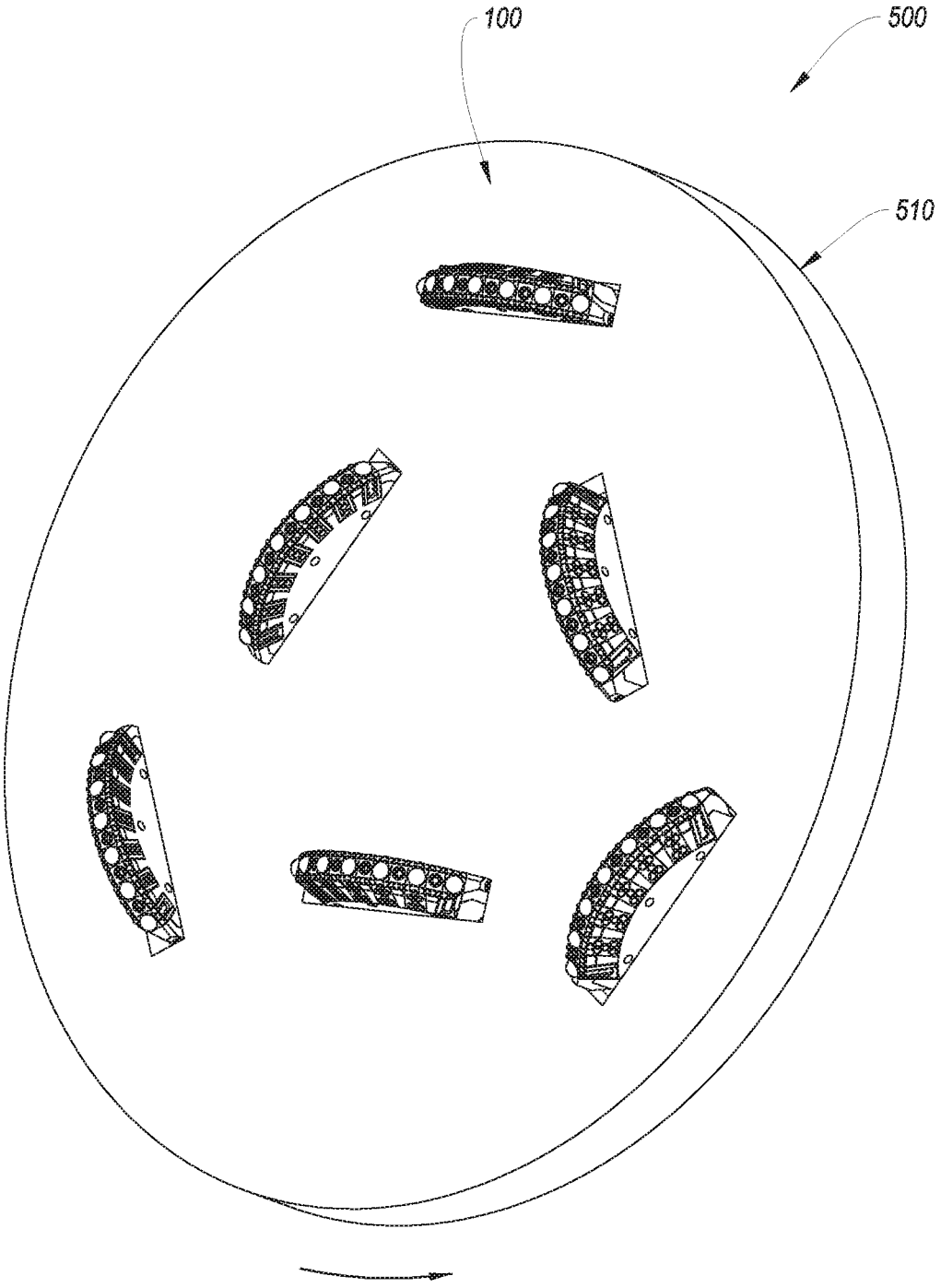
FIG. 13 is an isometric view of a cutterhead of a material-removal machine according to an embodiment.

Furthermore, in the embodiment illustrated in FIG. 13, the cutting tool assemblies 100 may be oriented relative to the cutterhead 510 such as to position the cutting elements and/or one or more surfaces of the cutterhead 510 at one or more suitable positions and/or orientations relative to the cutterhead 510 (e.g., relative to the front face of the cutterhead 510). For example, as described above, at least some of the cutting elements of one or more of the cutting tool assemblies may be positioned along an arcuate path, and when the cutting tool assemblies 100 are secured to the cutterhead 510, at least some of the cutting elements of at least one of the cutting tool assembly 100 may be positioned at different distances from the front face of the cutterhead 510.

Additionally or alternatively, at least one cutting tool of at least one cutting tool assembly 100 may include one or more slanted surfaces that, when the cutting tool assembly 100 is secured to the cutterhead 510, may be oriented at an obtuse or an acute angle relative to the front face of the cutterhead 510. In some embodiments, as described above, one or more additional or alternative cutting elements may be secured near and/or extend outward from the slanted surface(s) of the cutting tool(s). For example, centerline(s) of corresponding ones of the one or more additional cutting tools may extend substantially perpendicularly to the corresponding slanted surfaces(s).

In some embodiments, the mounting and/or orientation surfaces may be generally flat or planar (e.g., a flat or planar surface may abut or may be pressed against a corresponding flat or planar surface on cutterhead 510, as shown in FIG. 12). For example a front surface 112 and/or an opposing back surface of the base body 110 may position and/or orient the cutting tool assembly 100 on a cutterhead. It should be appreciated, however, that the base body 110 may have any number of surfaces or faces that may be sized and configured to position and/or orient the cutting tool assembly 100 on a cutterhead, and which may have any number of suitable shapes and/or sizes.

In any event, in one or more embodiments, when the cutting tool assembly 100 is a mounted or secured to a cutterhead of a material-removal system, the cutting elements 210 may be positioned and oriented in a manner that facilitates engagement thereof with the target material during operation of the material-removal system. For example, one, some, or all of the cutting elements 210 my face generally in a direction extending outward from the front surface 112 and/or from the back surface. Additionally or alternatively, one, some, or all of the cutting elements 210 generally lie along the curved reference line 10. In some embodiments, one, some, or all of the cutting elements 210 may face in a direction generally perpendicular to an imaginary line that is tangent to the curved reference line 10 at the location of a particular cutting element 210, when the corresponding cutting tool is mounted to a cutterhead.

As discussed below in more detail, the cutting tools 200 may be secured to the base body 110 with one or more clamping members 300 (not all shown) and/or with one or more clamping members 300', 300" (not all shown). For example, the clamping members 300 may be fastened to the base body 110 with one or more fasteners 400 (not all shown). In one or more embodiments, each of the clamping members 300 may include a clamp body 310 and an recess 320 therein that may facilitate insertion of the fastener 400 into the clamping members 300, such that the fasteners 400 may be fastened or screwed into the base body 110 (e.g., into a threaded opening in the base body 110). For example, the recess 320 may include a through hole and a counterbore that may facilitate a head of the fastener 400.

Moreover, in some embodiments, fastening the clamping members 300 to the base body 110 may clamp or otherwise secure cutting tools 200 to the base body 110. For example, the clamping members 300 may apply pressure to one or more of the cutting tools 200 in a manner that secures the cutting tools 200 to the base body 110 (e.g., one, some, or all of the clamping members 300 may apply pressure to cutting tool(s) 200 adjacent thereto. Additionally or alternatively, the cutting tools 200 may be fastened (e.g., bolted or screwed) or otherwise secured to the base body 110.

In some embodiments, the clamping members 300 may include one or more cutting elements 210. Alternatively, however, the clamping members 300 may include no cutting elements. In any event, in the illustrated embodiment, the clamping members 300 clamp and/or otherwise selectively and/or removably secure the cutting tools 200 adjacent thereto to the base body 110.

In an embodiment, the base body 110 may include one or more tool positioning features 120 (not all labeled) that may position and/or orient the cutting tools 200 on the base body 110 (e.g., the tool positioning features 120 may position and/or orient the cutting tools 200 relative to the mounting and/or orientation surfaces, such as relative to the front surface 112 and/or the back surface of the base body 110). For example, the tool positioning features 120 may be sized, shaped, or otherwise configured to accept corresponding or complementary shapes of the cutting tools 200 mounted thereto (e.g., the tool positioning features 120 may interface with corresponding positioning features of the cutting tools 200 to position and orient the cutting tools 200 on the base body 110). In some embodiments, the tool positioning features 120 may be configured to restrict or limit rotation and/or other movement of the cutting tools 200 relative to the base body 110. Additionally or alternatively, the tool positioning features 120 may position and/or orient the cutting tools 200 relative to the base body 110 in a manner that facilitates fastening the cutting tools 200 to the base body 110 at suitable and/or predetermined relative positions and/or orientations.

As described above, the clamping members 300, 300', 300" may clamp the cutting tools 200 to the base body 110. In an embodiment, bottoms of the clamping members 300 may be positioned on and/or pressed against corresponding upper surfaces 111 of the base body 110. For example, the upper surfaces 111 may be positioned or located on opposing sides of one, some, or each of the positioning features 120. As such, in some embodiments, the cutting tools 200 may be located on the positioning features 120 and may be clamped to the base body 110 by the clamping members 300 secured or fastened against the upper surfaces 111 on the opposing sides of the positioning features 120. Furthermore, in an embodiment, the positioning features 120 may at least partially restrain respective cutting tools 200 (e.g., in a manner that prevents or limits movement of the cutting tools 200). For example, the positioning features 120 may restrain the cutting tools 200 in a direction that is lateral to the clamping elements 300, 300', 300" (e.g., in a direction along the faces of the clamping elements 300, 300', 300" that clamp down and against corresponding faces of the cutting tools 200).

In at least the illustrated embodiment, the cutting tool assembly 100 includes clamping member 300', which may be positioned at one end and clamping member 300" that may be positioned at an opposing ends of the base body 110 (e.g., the clamping member 300" (see FIG. 1B) may be a mirror image of the clamping member 300'). More specifically, for example, the cutting tool 200 closest to the end of the base body 110 may be clamped to the base body 110 by and between the clamping member 300' and one of the clamping members 300. Furthermore, a portion of the clamping members 300', 300" (FIG. 1B) may define or form an extension to one or more surfaces of the base body 110. For example, when the clamping member 300' is mounted or secured to the base body 110, one or more surfaces of the clamping member 300' may be coplanar with and/or extend from corresponding one or more surfaces of the base body 110.

In the illustrated embodiment, each of the tool positioning features 120 includes a partial channel 121 and a rib or protrusion 122 that extends outward from a bottom 123 of the channel 121 and toward the upper surfaces 111 of the base body 110. For example, the protrusion 122 may extend only partially between the bottom 123 and the upper surfaces 111 of the base body 110, such that an upper portion of the channel 121 extends through the base body 110. Explaining further, a portion of the channel 121 may be defined between two sidewalls of the base body 110, while a portion of the channel 121 may be defined by a portion of the protrusion 122. Alternatively, the protrusion 122 may extend from the bottom 123 to the upper surfaces 111 on the base body 110 such that, on one side, the channel 121 extends from the front surface 112 to the protrusion 122, and on the opposite side, the channel 121 extends from the back surface to the protrusion 122.

Upper surfaces 126 of the protrusions 122 may collectively generally follow the curved reference line 10. For example, the protrusion 122 may extend from a first side 124 to an opposing, second side 125 of the channel 121 and at a suitable angle to a bottom surface 113 of the base body. Moreover, protrusions 122 in each of the subsequent channels 121 (along the curved reference line 10) may have different or varying angles, such that the protrusions 122 collectively generally follow the curved reference line 10 (e.g., one, some, or each of upper surfaces 126 of the protrusions 122 may be generally planar or flat, and the planar surfaces may be arranged to collectively define a generally curved surface consisting of multiple planar segments).

In alternative or additional embodiments, the protrusion 122 may only partially extend between the first side 124 and second side 125 (e.g., forming a gap between the protrusion 122 and first side 124 and/or between protrusion 122 and second side 125). In any case, according to at least one embodiment, the tool positioning features 120 may include a feature or member that may prevent or limit movement and/or rotation of the corresponding cutting tools 200 relative to the base body 110. In some embodiments, the protrusion 122 of the tool positioning features 120 may prevent or limit rotation or twisting of the cutting tools 200 about an axis passing through one or more of the cutting elements 210. Additionally or alternatively, the protrusion 122 may prevent or limit rotation or twisting of the cutting tools 200 into and/or out of plane relative to the front surface 112 and/or back surface of the base body 110.

In some embodiments, the cutting tools 200 may include one or more positioning features that may correspond to and/or may be complementary with the tool positioning features 120 of the base body 110, such that connecting or collocating the respective positioning features of the base body 110 and cutting tools 200 positions and orients the cutting tools 200 on the base body 110. More specifically, for example, the general shape and/or size of the cutting tool body 220 may position and/or orient the cutting tool 200 relative to the base body 110. In the illustrated embodiment, the cutting tool body 220 includes a notch or channel 230 that has a complementary shape and size with the protrusion 122. The cutting tools 200 may be at least partially positioned within the tool positioning features 120, such that a portion of the cutting tool body 220 is positioned in the channel 121 and/or at least a portion of the protrusion 122 is positioned within the channel 230 in the cutting tool body 220.

Generally, the corresponding tool positioning features 120 and positioning features of the cutting tools 200 may have suitable clearance therebetween to facilitate relative positioning thereof. In an embodiment, the channel 230 and the protrusion 122 may be sized to have a suitable gap or clearance therebetween, which may facilitate mounting the channel 230 over the protrusion 122 (e.g., the channel 230 and the protrusion 122 may have a sliding fit therebetween). Moreover, the channel 121 and the cutting tool body 220 may be sized and shaped to have a suitable clearance therebetween. Alternatively, the cutting tool body 220 may be press-fit into the channel 121 and/or the protrusion 122 may be press-fit into the channel 230 in the cutting tool body 220.

In some embodiments, the bottom 123 and/or the top surface 126 of the protrusion 122 may locate and/or orient the cutting tool 200 relative to the base body 110 and/or relative to the curved reference line 10. For example, the bottom 123 and/or the top surface 126 of the protrusion 122 may position or locate the cutting tool 200 at a predetermined depth relative to the upper surfaces 111. In an embodiment, the cutting tool body 220 may have one or more surfaces that may correspond to and abut the bottom 123 and/or top surface 126, when the cutting tool 200 is mounted to the tool positioning feature 120. In particular, for example, abutting the corresponding surface(s) of the cutting tool body 220 on the bottom 123 and/or the top surface 126 may limit the depth of the position of the cutting tool 200 relative to the upper surfaces 111. In an embodiment, the bottom 123 and/or the top surface 126 together with the sidewalls that define a periphery of the protrusion 122 may limit or prevent rotation or twisting of the cutting tool 200 within the channel 121 as well as into and/or out the plane relative to the front surface 112 and/or back surface (e.g., corresponding surfaces of the cutting tools 200 may abut or contact the protrusion 122, the top surface 126, the sidewalls of the protrusion 122, or combinations of the foregoing in a manner that prevents or limits in-plane and/or out-of-plane rotation or twisting of the cutting tools 200.

In an embodiment, portions of sidewalls 221 and 222 of the cutting tool body 220 may be angled or tapered, such as to form an acute included angle therebetween. For example, when the cutting tool 200 is mounted to the base body 110, a portion of the cutting tool body 220 may extend above the adjacent upper surfaces 111 of the base body 110 (e.g., the height of the cutting tool body 220 may be greater than the distance between the bottom 123 of the tool positioning features 120 and the adjacent upper surfaces 111). In some embodiments, a portion of the cutting tool body 220 that extends past the upper surfaces 111 may be tapered (e.g., angled portions 221', 222' of the sidewalls 221 and 222 extending above the upper surfaces 111 of the base body 110 may define an acute included angle). For example, the angle defined by the angled portions 221' and 222' of the sidewalls 221, 222 may be a relatively small angle, such as a 3° angle, a relatively large angle, such as 16° or greater, or any other suitable angle.

It should be appreciated that the angle defined by the angled portions 221' and 222' of the sidewalls 221, 222 may generally vary from one embodiment to the next. Moreover, in some embodiments, except for the angled portions 221', 222', the sidewalls 221, 222 may be generally parallel to each other. In an embodiment, the first side 124 and the second side 125 of the channel 121 may be generally parallel to each other and may be spaced apart at a distance similar to or the same as the distance between the lower or parallel portions of the sidewalls 221, 222 that fit into the channel 121 of the tool positioning features 120.

As mentioned above, when the clamping members 300 and/or 300', 300" are fastened to the base body 110, the clamping members 300, 300', 300" may clamp or press the cutting tools 200 to the base body 110 (e.g., into the channel 121 of the tool positioning features 120). In some embodiments, clamp body 310 of the clamping members 300 may include opposing sidewalls 311, 312 that may define an included angle similar to or the same as the included angle defined by the angled portions 221' 222' of the sidewalls 221, 222. The angle defined by the angled portions 221' 222' of the sidewalls 221, 222, however, may form a narrower portion of the cutting tool body 220 near an upper surface 223 thereof (e.g., the width of the cutting tool body 220, as defined by and between the sidewalls 221, 222, may increase from the upper surface 223 downward and toward the base body 110). Conversely, the angle defined by the opposing sidewalls 311, 312 of the clamp body 310 may form the narrower portion of the clamp body 310 near bottom thereof (e.g., closer to the base body 110) and a wider portion of the clamp body 310 near or at an upper surface 313. For example, the shape or angle defined by the sidewalls 311, 312 of the clamping members may be complimentary to the shape or angle defined by the angled portions 221', 222' of the sidewalls 221, 222.

In some embodiments, the clamping members 300 may be positioned between adjacent cutting tools 200, such that the angle or taper of the clamp body 310, defined by the sidewalls 311 and 312, may be the same as or generally complementary to the taper formed or defined by and between the sidewall 221 of a one of the cutting tools 200 and sidewall 222 of another of the cutting tools 200. Optionally, as shown in FIG. 1B, the clamping members 300 (not all labeled) may clamp or apply downward force (e.g., toward the base body 110) onto adjacent cutting tools 200 (not all labeled). For example, angled sidewalls of the clamping members 300 may abut or contact corresponding angled portions of the sidewalls of the adjacent cutting tools 200.

In an embodiment, one, some, or each of the cutting tools 200 may have two clamping members 300 positioned on opposing sides to clamp the corresponding cutting tool 200 to the base body 110. For example, clamping member 300*a* may be positioned on a right side of the cutting tools 200, such that sidewall 312*a* contacts and/or presses against a corresponding angled portion 221' portion of the sidewall of the cutting tool 200. A clamping member 300*b* may be positioned on a left side of the cutting tool 200, such that the sidewall 311*b* of the clamp body 310 contacts and/or presses against a corresponding angled portion 222' of the sidewall of the cutting tool 200. As mentioned above, the size and configuration of the clamping members 300 may be configured such that fastening the clamping members 300 to the base body 110 produces a clamping force (e.g., the sidewalls of clamping members 300 may contact the angled portions of the sidewalls of the adjacent cutting tools 200 to produce a force on the cutting tools 200 that is generally toward the base body 110).

In the illustrated embodiment, the cutting tool 200 positioned near the end of the base body 110 may be clamped between the clamp element 300', 300" and the clamp element 300*a*. In an embodiment, a cutting tool 200' may be similar to or the same as any of the cutting tools 200. For example, the cutting tool 200' may have opposing sidewalls with angled portions that may be clamped by and between the clamping members 300', 300" and 300 in any manner as described above.

Generally, the angle or taper defined or formed by and between opposing sidewalls of the clamping member 300 may be generally complementary to, the same as, or similar to the angle formed or defined by and between the angled portions of the sidewalls of the cutting tools 200 adjacent to the clamping member 300. As described above, in some embodiments, one, some, or each of the cutting tools 200 may have sidewalls that define angled or tapered portion of the cutting tool body, and the tapered portion may have the same taper or included angle as the clamping members 300. Alternatively, the taper or included angle of the tapered portions of the cutting tools 200 may vary from one to another and/or may have an included angle that is different from the included angle or taper of one, some, or each of the clamping members 300. In any event, the clamping members 300, 300', 300" and at least upper portions of the cutting tools 200 may be sized and configured such that fastening the clamping members 300 to base body 110 applies clamping force (e.g., a generally downward force) to the cutting tools 200 (e.g., such that the cutting tools 200 may be secured to the base body 110 without directly securing the cutting tools 200 to the base body 110 with fastener(s)).

In some embodiments, one, some, or all of the clamping members 300, 300', 300" may be loosened and/or removed (e.g., by loosening and/or removing the corresponding fasteners that may secure the clamping members 300 to the base body 110). Moreover, as described above, loosening and/or removing the clamping members 300 from the base body 110 may facilitate removal and/or replacement of the cutting tools 200. For example, when suitable or desirable, one, some, or all of the cutting tools 200 may be removed and replaced. Furthermore, in some instances, one, some, or all of the replacement cutting tools may be the same as or similar to the removed cutting tools. Alternatively, one, some, or all of the replacement cutting tools may be different from the removed cutting tools.

As such, in some embodiments, the cutting tool assembly 100 may be generally modular. For example, the cutting tool assembly 100 may be at least partially assembled on the worksite (e.g., one, some, or all of the cutting tools may be selected and/or secured to the base body 110 at the worksite). Additionally or alternatively, the cutting tool assembly 100 may be reconfigurable, such that one, some, or all of the cutting tools 200 and/or clamping members 300', 300" may be removed, rearranged, and/or replaced with one or more suitable cutting tools and/or clamping members (e.g., as may be suitable for particular operating conditions).

As mentioned above, the cutting tool assembly 100 may be mounted or secured to the cutterhead of a material-removal system. For example, the base body 110 may include one or more mounting holes (e.g., mounting holes 114); one or more corresponding fasteners may pass through the mounting holes and may fasten the base body 110 (and cutting tool assembly 100) to the cutterhead. In some embodiments, one, some, or all of the clamping members 300 may be loosened and/or removed from the base body 110 without removing the base body 110 from the cutterhead of the material-removal system. Moreover, one, some, or all of the cutting tools 200 may be removed and/or replaced (e.g., after loosening and/or removing the clamping members 300, 300', 300") without removing the base body 110 from the cutterhead.

As such, for example, one or more of the cutting tools 200 may be replaced with replacement cutting tools due to wear and/or failure of one or more of the cutting tools 200 and/or elements or components thereof (e.g., due to wear and/or failure of one or more cutting elements). In some embodiments, removal and/or replacement of the cutting tools may be performed more efficiently than with a conventional cutting tool assembly that may require removal thereof from the cutterhead. Hence, under some operating conditions, worn out and/or failed cutting tools may be replaced with replacement cutting tools in a manner that results in less operating downtime of the material-removal system (as compared with replacement of conventional cutting tools).

Also, the cutterhead of the material-removal system may be reconfigured during operation (e.g., in response to change(s) in the target material). In some embodiments, the cutting tools may be removed and/or replaced with one or more cutting tools that may be selected based on a property of the target material (e.g., a change in the target material may occur during material-removal operation). For example, the target material intended for cutting may change as the material-removal system advances into and removes the target material. In an embodiment, the cutting tools and/or clamping members may be changed to accommodate a property of the target material (e.g., from cutting tools configured to engage and/or fail harder material to cutting tools configured to engage and/or fail software material, or vice versa).

Figure 2A:
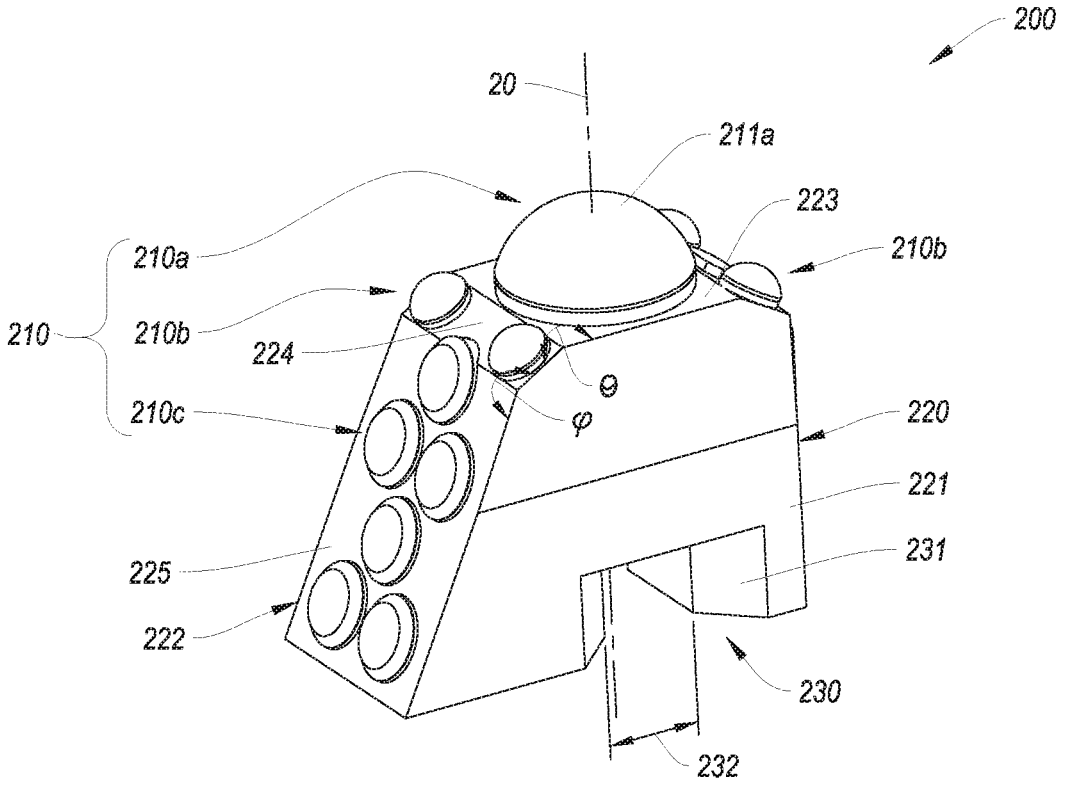
FIG. 2A is a front isometric view of a cutting tool according to an embodiment.
Figure 2B:
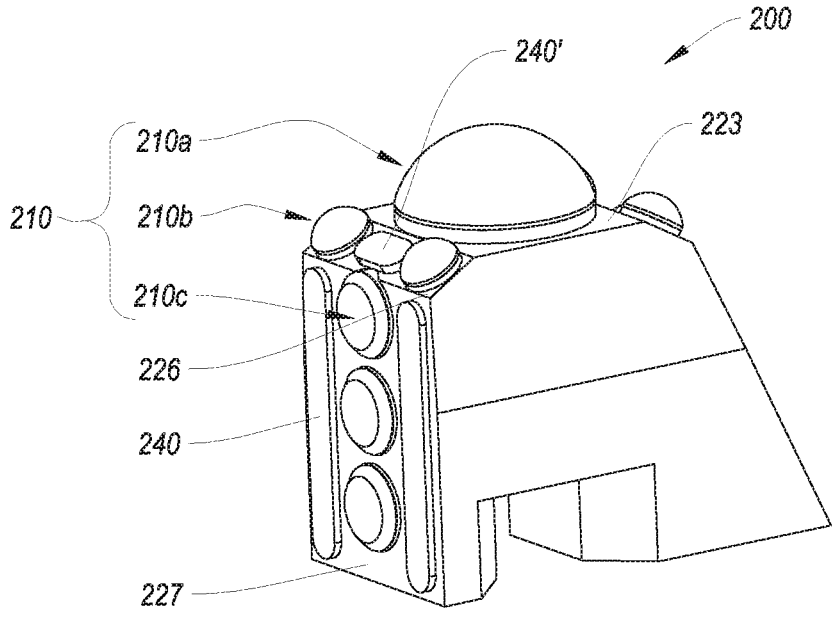
FIG. 2B is a back isometric view of the cutting tool of FIG. 2A.

FIGS. 2A and 2B are an isometric view of the cutting tool 200. As described above, in some embodiments, the cutting tool 200 includes the channel 230 extending through the cutting tool body 220. For example, the tool positioning feature may include a rib or protrusion that may extend at least partially into the channel 230 and orient and/or at least partially secure or restrict movement of the cutting tool 200 relative to the base body of the cutting tool assembly.

In some embodiments, the protrusion may extend between opposing sides of a channel and may include radii or fillets forming transitions between the protrusion and opposing sides of the channel (e.g., the radii or fillets may be formed by and/or intended to accommodate fabrication of the protrusion). Optionally, the cutting tool 200 may include fillets or chamfers 231 (not all labeled).

Also, as mentioned above, the channel 230 may have a width 232 that is suitable for accepting the corresponding protrusion of the base body 110. For example, the width 232 of the channel 230 may be suitably greater than the width of the protrusion to facilitate positioning the channel 230 over the protrusion with a suitable clearance therebetween. In any event, the channel 230 may be sized and configured to accept or to be positioned adjacent to a corresponding protrusion of the base body.

In the illustrated embodiment, the cutting tool 200 includes multiple cutting elements 210 (e.g., cutting elements 210*a*, 210*b*, 210*c* (not all labeled)). In some embodiments, the cutting elements 210 may include polycrystalline diamond defining one or more working surfaces of corresponding cutting elements 210. In particular, for example, each of the cutting elements 210*a* may include a working surface 211*a*, each of the cutting elements 210*b* may include a working surface 211*b*, and each of the cutting elements 210*c* may include a working surface 211*c*; each of the working surfaces 211*a*, 211*b*, 211*c* may have or define any suitable shape that may vary from one embodiment to the next. In an embodiment, the working surface 211*a* and working surface 211*b* may define a generally rounded or a semi-spherical shape, and the working surface 211*c* may be generally dome-shaped.

Furthermore, in some embodiments, the working surfaces of the cutting elements 210 may be formed or defined by superhard tables bonded to corresponding substrates. The superhard tables of one, some, or each of the cutting elements may comprise polycrystalline diamond, and one, some, or each of the corresponding substrates may comprise cobalt-cemented tungsten carbide. Furthermore, in any of the embodiments disclosed herein, the polycrystalline diamond table may be leached to at least partially remove or substantially completely remove a metal-solvent catalyst (e.g., cobalt, iron, nickel, or alloys thereof) that was used to initially sinter precursor diamond particles to form the polycrystalline diamond.

In another embodiment, an infiltrant used to re-infiltrate a preformed leached polycrystalline diamond table may be leached or otherwise removed to a selected depth from a superhard working surface. Moreover, in any of the embodiments disclosed herein, the polycrystalline diamond may be un-leached and include a metal-solvent catalyst (e.g., cobalt, iron, nickel, or alloys thereof) that was used to initially sinter the precursor diamond particles that form the polycrystalline diamond and/or an infiltrant used to re-infiltrate a preformed leached polycrystalline diamond table. Examples of methods for fabricating the superhard tables and superhard materials and/or structures from which the superhard tables and elements may be made are disclosed in U.S. Pat. Nos. 7,866,418; 7,998,573; 8,034,136; and 8,236,074; the disclosure of each of the foregoing patents is incorporated herein, in its entirety, by this reference.

The diamond particles that may be used to fabricate the superhard table in a high-pressure/high-temperature process ("HPHT)" may exhibit a larger size and at least one relatively smaller size. As used herein, the phrases "relatively larger" and "relatively smaller" refer to particle sizes (by any suitable method) that differ by at least a factor of two (e.g., 30 μm and 15 μm). According to various embodiments, the diamond particles may include a portion exhibiting a relatively larger size (e.g., 70 μm, 60 μm, 50 μm, 40 μm, 30 μm, 20 μm, 15 μm, 12 μm, 10 μm, 8 μm) and another portion exhibiting at least one relatively smaller size (e.g., 15 μm, 12 μm, 10 μm, 8 μm, 6 μm, 5 μm, 4 μm, 3 μm, 2 μm, 1 μm, 0.5 μm, less than 0.5 μm, 0.1 μm, less than 0.1 μm). In an embodiment, the diamond particles may include a portion exhibiting a relatively larger size between about 10 μm and about 40 μm and another portion exhibiting a relatively smaller size between about 1 μm and 4 μm. In another embodiment, the diamond particles may include a portion exhibiting the relatively larger size between about 15 μm and about 50 μm and another portion exhibiting the relatively smaller size between about 5 μm and about 15 μm. In another embodiment, the relatively larger size diamond particles may have a ratio to the relatively smaller size diamond particles of at least 1.5. In some embodiments, the diamond particles may comprise three or more different sizes (e.g., one relatively larger size and two or more relatively smaller sizes), without limitation. The resulting polycrystalline diamond formed from HPHT sintering the aforementioned diamond particles may also exhibit the same or similar diamond grain size distributions and/or sizes as the aforementioned diamond particle distributions and particle sizes. Additionally, in any of the embodiments disclosed herein, the superhard elements may be free-standing (e.g., substrateless) and/or formed from a polycrystalline diamond body that is at least partially or fully leached to remove a metal-solvent catalyst initially used to sinter the polycrystalline diamond body.

As noted above, the superhard table may be bonded to the substrate. For example, the superhard table comprising polycrystalline diamond may be at least partially leached and bonded to the substrate with an infiltrant exhibiting a selected viscosity, as described in U.S. patent application Ser. No. 13/275,372, entitled "Polycrystalline Diamond Compacts, Related Products, And Methods Of Manufacture," the entire disclosure of which is incorporated herein by this reference. In an embodiment, at least partially leached polycrystalline diamond table may be fabricated by subjecting a plurality of diamond particles (e.g., diamond particles having an average particle size between 0.5 μm to about 150 μm) to an HPHT sintering process in the presence of a catalyst, such as cobalt, nickel, iron, or an alloy of any of the preceding metals to facilitate intergrowth between the diamond particles and form a polycrystalline diamond table comprising bonded diamond grains defining interstitial regions having the catalyst disposed within at least a portion of the interstitial regions. The as-sintered polycrystalline diamond table may be leached by immersion in an acid or subjected to another suitable process to remove at least a portion of the catalyst from the interstitial regions of the polycrystalline diamond table, as described above. The at least partially leached polycrystalline diamond table includes a plurality of interstitial regions that were previously occupied by a catalyst and form a network of at least partially interconnected pores. In an embodiment, the sintered diamond grains of the at least partially leached polycrystalline diamond table may exhibit an average grain size of about 20 μm or less. Subsequent to leaching the polycrystalline diamond table, the at least partially leached polycrystalline diamond table may be bonded to a substrate in an HPHT process via an infiltrant with a selected viscosity. For example, an infiltrant may be selected that exhibits a viscosity that is less than a viscosity typically exhibited by a cobalt cementing constituent of typical cobalt-cemented tungsten carbide substrates (e.g., 8% cobalt-cemented tungsten carbide to 13% cobalt-cemented tungsten carbide).

Additionally or alternatively, the superhard table may be a polycrystalline diamond table that has a thermally-stable region, having at least one low-carbon-solubility material disposed interstitially between bonded diamond grains thereof, as further described in U.S. patent application Ser. No. 13/027,954, entitled "Polycrystalline Diamond Compact Including A Polycrystalline Diamond Table With A Thermally-Stable Region Having At Least One Low-Carbon-Solubility Material And Applications Therefor," the entire disclosure of which is incorporated herein by this reference. The low-carbon-solubility material may exhibit a melting temperature of about 1300° C. or less and a bulk modulus at 20° C. of less than about 150 GPa. The low-carbon-solubility, in combination with the high diamond-to-diamond bond density of the diamond grains, may enable the low-carbon-solubility material to be extruded between the diamond grains and out of the polycrystalline diamond table before causing the polycrystalline diamond table to fail during operations due to interstitial-stress-related fracture.

In some embodiments, the polycrystalline diamond, which may form the superhard table, may include bonded-together diamond grains having aluminum carbide disposed interstitially between the bonded-together diamond grains, as further described in U.S. patent application Ser. No. 13/100,388, entitled "Polycrystalline Diamond Compact Including A Polycrystalline Diamond Table Containing Aluminum Carbide Therein And Applications Therefor," the entire disclosure of which is incorporated herein by this reference.

In an embodiment, the cutting elements 210*a* may be positioned to extend outward from an upper surface 223 of the cutting tool body 220. For example, the superhard table defining the working surface 211*a* of the cutting elements 210*a* may be positioned above the upper surface 223 of the cutting tool body 220. In any event, the working surface 211*a* of the cutting elements 210*a* may be exposed beyond the cutting tool body 220, such that during operation, the working surface 211*a* may engage the target material.

Generally, the cutting tool 200 may have any number of suitable shapes and/or sizes, which may vary from one embodiment to another. Moreover, as described above, the tool positioning feature(s) on the base body and corresponding positioning features on the cutting tool 200 (e.g., the channel 230, the shape and/or size of the cutting tool body) may position the cutting tool 200 relative to the base body of the cutting tool assembly. Accordingly, when the cutting tool 200 is mounted to the base body of the cutting tool assembly, the upper surface 223 may be positioned at a suitable location along the curved reference line (described above).

In some embodiments, a centerline 20 of the cutting element 210*a* may be generally perpendicular to the upper surface 223. For example, when the cutting tool 200 is mounted to the base body of the cutting tool assembly, a point on the working surface 211*a* of the cutting element 210*a* may lie on the curved reference line (described above). In alternative or additional embodiments, the centerline 20 of the cutting elements 210*a* may have any suitable orientation relative to the upper surface 223. Furthermore, the cutting elements 210*a* may be positioned at any number of suitable locations relative to the periphery of the cutting tools 200 (e.g., the cutting elements 210*a* may be positioned such that the centerline 20 thereof may be approximately in the center of the upper surface 223, as defined by peripheral surfaces of the cutting tool body 220).

In one or more embodiments, the cutting tool 200 may include one or more slanted surfaces, each of which may be oriented at a non-parallel or a non-perpendicular angle relative to the upper surface 223. For example, the cutting tool body 220 may include a slanted surface 224 and a slanted surface 225 oriented at obtuse angles relative to the upper surface 223. In an embodiment, the slanted surface 224 and slanted surface 225 may define a side of the cutting tool 200.

For example, the slanted surface 224 and the upper surface 223 may define an angle θ therebetween, which may be between 181° and 265° (e.g., 210°). The slanted surface 224 and slanted surface 225 may define and angle φ therebetween, which may be between 181° and 265° (e.g., 210°). As such, for example, the angle defined by the upper surface 223 and slanted surface 225 may be between 181° and 265° (e.g., 240°).

The cutting tool body 220 also may include surfaces 226, 227 (FIG. 2B), described below in more detail. In some embodiments, the surface 226 and the upper surface 223 may define or form the same angle as the slanted surface 224 and upper surface 223. Moreover, the surface 227 and upper surface 223 may be approximately perpendicular to each other (e.g., such that the centerline 20 of the cutting elements 210*a* is approximately parallel to the surface 227). In some embodiments, surfaces 226 and 227 may be trailing surfaces (i.e., generally facing away from the direction of cut or movement of the cutting tool 200 during operation).

It should be also appreciated that as the cutting tools may have any suitable outer shape that, for example, may be at least in part defined by the cutting tool body. Moreover, the outer shape and/or size of the cutting tool assembly may be defined by the cutting tools and corresponding shapes thereof. For example, as the cutting tool assembly advances into and/or through the target material, removal or failure of the target material may produce a corresponding negative shape or channel in the target material, the shape and size of which may be at least in part defined by the outer shape and size of the cutting tool assembly and by the outer shapes and/or size of the cutting tools of the cutting tool assembly.

In some embodiments, the slanted surface 224 and/or the slanted surface 225 may include one or more cutting elements 210*b* and 210*c*, respectively. For example, the cutting elements 210*b* may be positioned to generally extend beyond the slanted surface 224, and the cutting elements 210*c* may be positioned to generally extend beyond the slanted surface 225. In some embodiments, the cutting elements 210*b* may be oriented such that corresponding centerlines thereof are approximately perpendicular to the slanted surface 224. Additionally or alternatively, the cutting elements 210*c* may be oriented such that corresponding centerlines thereof are approximately perpendicular to the slanted surface 225.

Generally, the cutting tool 200 may include any suitable number of the cutting elements 210*b* and/or 210*c*, which may be arranged and/or oriented on the cutting tool body 220 in any number of suitable orientations and arrangements. In an embodiment, the cutting elements 210*b* may be positioned near the respective sidewalls 221 and 222 of the cutting tool body 220 (e.g., the cutting tool 200 may include two cutting elements 210*b* extending outward past the slanted surface 224). Also, for example, some of the cutting elements 210*c* may be arranged side by side (e.g., along a width of the cutting tool body 220 as defined between the sidewalls 221 and 222), while other cutting elements 210*c* may be individually positioned (e.g., a single cutting element 210*c* along the width of the cutting tool body 220). For example, the arrangement of the cutting elements 210*c* may include a single cutting elements 210*c* positioned in a first row, two cutting elements 210*c* positioned in a second row, again a single cutting elements 210*c* positioned in a third row, and so on (e.g., where the rows are arranged along a length of the slanted surface 225, as defined from the slanted surface 224 a bottom of the cutting tool body 220).

Furthermore, the rows may be generally parallel to the width of the cutting tool body 220 (e.g., generally perpendicular to one or more of the sidewalls 221, 222). Alternatively, one, some, or all of the rows may be slanted relative to the sidewalls 221, 222. It should be also appreciated that the cutting elements 210*c* may be arranged in any number of suitable arrangement relative to peripheral surfaces of the cutting tool body 220 (e.g., relative to the second slanted surface 224).

Generally, the cutting tool body 220 of the cutting tool 200 may comprise any suitable material (e.g., steel, such as alloy steel, tool steel, stainless steel, carbide, cemented carbide, other ceramics, combinations of the foregoing, etc.). Under some operating conditions, one or more portions of the slanted surfaces 224 and/or 225 may contact the target material. As such, cutting tool 200 may include hardfacing or protective coatings on one or more portions of the slanted surfaces 224 and/or 225. The protective coating(s) may improve abrasion, erosion, and/or wear resistance of the slanted surface 224 and slanted surface 225 (e.g., as compared to uncoated or unprotected material of the cutting tool body 220). For example, the coatings may reduce wear of the slanted surface 224 and slanted surface 225 (compared to the wear without the coatings).

In alternative or additional embodiments, the slanted surfaces 224 and/or 225 may include shielding elements mounted thereon and/or extending outward therefrom. For example, the shielding elements may include or comprise a superhard material, such as carbide, cubic boron nitride, polycrystalline diamond, etc. In any event, the shielding elements may protect the slanted surfaces 224 and/or 225 from abrasion and wear during operation of the cutting tool 200.

In an embodiment, the shielding elements may be polycrystalline diamond compacts, cemented carbide blocks or plates, etc., which may be secured or mounted to the cutting tool body 220. For example, the shielding elements may be similar to or the same as one, some, or each of the cutting elements (e.g., under some operating conditions, the shielding elements may generally contact failed target material after failure thereof and or may generally not cut or otherwise fail the target material). Moreover, it should be appreciated that one or more cutting elements (e.g., cutting elements 210) may shield or protect at least a portion of one or more surfaces of the cutting tool body 220.

Surfaces 226 and 227 may have similar configurations as the respective slanted surfaces 224, 225. As shown in FIG. 2B, for example, the cutting tool 200 may include cutting elements 210*b* (not all labeled) that have working surfaces 211*b* (not all labeled) extending outward beyond surface 226 and cutting elements 210*c* (not all labeled) that have working surfaces 211*c* (not all labeled) extending outward beyond the surface 227 of the cutting tool body 220. In an embodiment, the cutting tool 200 may include cutting elements 210*b* positioned and/or arranged relative to surface 226 in the same or similar manner as other cutting elements 210*b* (described above) relative to slanted surface 224 (FIG. 2A).

In some embodiments, the cutting tools 200 may include cutting elements 210*c* positioned and/or arranged to extend outward beyond surface 227. In the illustrated embodiment, the cutting elements 210*c* extending outward beyond surface 227 may form a single column, extending along a length of surface 227 (as defined between the upper surface 223 and the bottom of the cutting tool body 220). Generally, however, the cutting elements 210*c* extending outward from surface 227 may have any number of suitable arrangement and/or orientations. For example, the cutting elements 210*c* extending outward from surface 227 may be arranged in the same manner as the cutting elements 210*c* extending outward from the slanted surface 225.

In an embodiment, the cutting tool 200 may include one or more shielding elements (e.g., shielding elements 240, 240') that may protect one or more peripheral surfaces of the cutting tool body 220, which may be exposed to wear and/or abrasion during operation. For example, the surface 227 may be shielded or protected by shielding elements 240, 240' (not all labeled), which may be positioned on both sides of the cutting elements 210*c* and may extend along the length of the surface 227. In some embodiments, the surface 226 may include the shielding element 240', which may be positioned between the cutting elements 210*b*. Additionally or alternatively, the surfaces 226 and/or 227 may include protective coating(s) thereon.

Figure 3A:
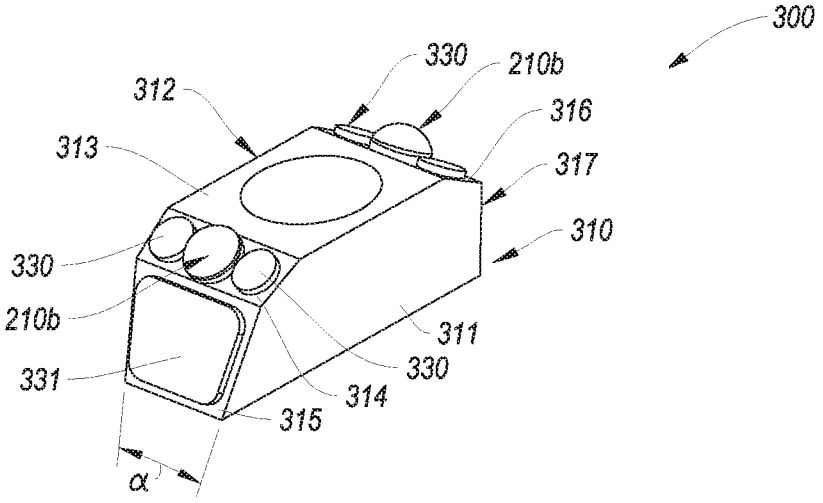
FIG. 3A is an isometric view of a clamping member according to an embodiment.

As mentioned above, the cutting tools 200 may be secured to the base body of the cutting tool assembly with one or more clamping members. FIG. 3A illustrates a clamping member 300 according to an embodiment. As described above, the clamping member 300 may include the clamp body 310 that may be at least partially defined by sidewalls 311 and 312. Moreover, the sidewalls 311 and 312 may define an angle α therebetween, which may facilitate securing the cutting tools 200 (FIGS. 1A-1B).

In the illustrated embodiment, the clamping member 300 includes an upper surface 313, slanted surfaces 314, 315, which may be slanted relative to the upper surface 313, and surfaces 316, 317. For example, the slanted surfaces 314 and/or 315 may have the same, similar, or different orientations and/or positions relative to the upper surface 313 as the slanted surfaces 224 and 225 relative to the upper surface 223 (FIG. 2A). As such, in some embodiments, when the cutting tool and the clamping members 300 are mounted to the base body of the cutting tool assembly, the upper surface 313 may extend from the upper surface 223 along the curved reference line 10 (FIGS. 1A-2B) and vice versa. Similarly, the slanted surface 314 may extend from the slanted surface 224 along the curved reference line 10 (FIGS. 1A-2B) or vice versa. In an embodiment, the slanted surface 315 may extend from the slanted surface 225 along the curved reference line 10 (FIGS. 1A-2B) or vice versa.

The surface 316 and/or surface 317 may have the same, similar, or different orientations and/or positions relative to the upper surface 313 as the surface 226 and surface 227 relative to the upper surface 223 (FIGS. 2A-2B). Similarly, when the clamping member 300 and the cutting tools are mounted to the base body of the cutting tool assembly, the surface 316 may extend from the surface 226 along the curved reference line 10 (FIGS. 1A-2B) or vice versa. In at least one embodiment, the surface 317 may extend from the surface 227 along the curved reference line 10 (FIGS. 1A-2B).

In the illustrated embodiment, the clamping member 300 includes cutting elements 210*b*. For example, the cutting elements 210*b* may be positioned on the slanted surface 314 and/or on the surface 316. It should be appreciated that the clamping member 300 may include any suitable number of cutting elements, which may be arranged on one or more surfaces thereof in any number of suitable arrangements.

In some embodiments, the clamping member 300 may include one or more shielding elements (e.g., shielding elements 330, 331 (not all labeled)), which may protect or shield one or more surfaces of the clamping member 300. For example, the shielding elements 330 may be positioned on or over and may protect at least a portion of the slanted surface 314 and/or the surface 316 (e.g., the cutting element 210*b* may be positioned generally in the center of the slanted surface 314, and the shielding elements 330 may be positioned adjacent to opposing sides of the cutting element 210*b*). In some embodiments, the shielding elements 331 may be positioned over at least a portion of the slanted surface 315 and/or the surface 317.

Generally, the shielding elements may have any number of suitable shapes, which may vary from one embodiment to another. In an embodiment, the shielding elements 330 may be generally circular. By contrast, the shielding elements 331 (not all labeled and one of the shielding elements 331 is not visible) may be trapezoidal (e.g., a shape that may be similar to the shape of the slanted surface 315).

Figure 3B:
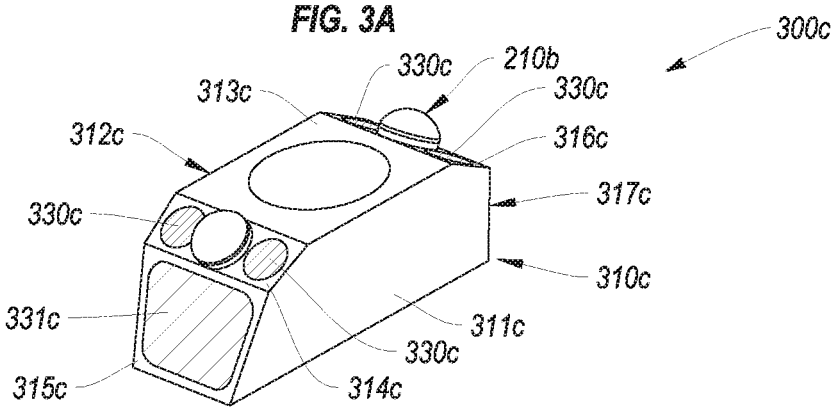
FIG. 3B is an isometric view of a clamping member according to another embodiment.

Alternatively or additionally, one or more surface of the clamping member may include protective coating(s). FIG. 3B illustrates a clamping member 300*c* according to an embodiment. Except as otherwise described herein, the clamping member 300*c* and its materials, components, elements, or features may be similar to or the same as the clamping member 300 (FIG. 3A) and its corresponding materials, components, elements, and features. In an embodiment, the clamping member 300*c* may have the same or similar shape as the clamping member 300 (FIG. 3A). For example, the clamping member 300*c* may include sidewalls 311*c*, 312*c* (defining an acute angle therebetween), an upper surface 313*c*, slanted surfaces 314*c*, 315*c*, and surfaces 316*c*, 317*c* (similar to the clamping member 300 (FIG. 3A)).

In an embodiment, in lieu of or in addition to the shielding elements, the clamping member 300*c* may include protective coating(s). For example, the slanted surface 314*c* and/or the surface 316*c* may include protective coatings 330*c* positioned adjacent to the cutting elements 210*b*. The protective coatings 330*c* may include hardfacing (including laser hardfacing), high velocity oxygen fuel ("HVOF") coating, nickel coating, etc. In some embodiments, the slanted surface 315*c* and/or the surface 317*c* may include at least one protective coating 331*c* (e.g., one or more protective coatings may cover the majority of slanted surface 315*c* and/or surface 317*c* or substantially all of the slanted surface 315*c* and/or the surface 317*c*).

Figure 4:
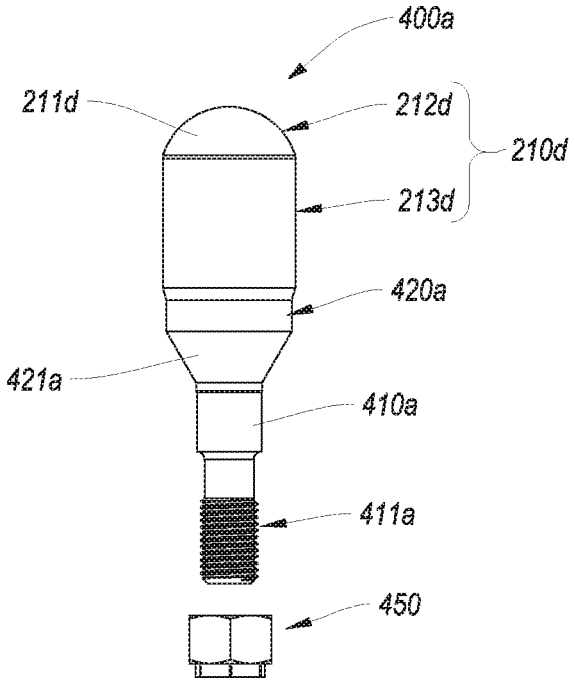
FIG. 4 is an side view of a fastener with a cutting element according to an embodiment.

As described above, the clamping members may be secured to the base body of the cutting tool assembly with one or more fasteners 400 (FIGS. 1A-1B). Furthermore, as shown in FIG. 4, a fastener 400*a*, according to one or more embodiments, may include a cutting element cutting element, such as a cutting element 210*d*. For example, the fastener 400*a* may include an elongated shaft 410*a* and a male thread 411*a* thereon. Except as otherwise described herein, the fastener 400*a* and its materials, components, elements, or features may be the same as or similar to the fastener 400 (FIG. 1A) and its corresponding materials, components, elements, and features.

Generally, the male thread 411*a* may be threaded into any suitable female thread to secure the fastener 400*a* and a clamping member to the base body of the cutting tool assembly. For example, as described above, the male thread 411*a* may be threaded into the base body 110 of the cutting tool assembly 100, thereby securing the clamping member to the base body 110. Alternatively, the base body 110 may include a through hole, and the male thread 411*a* may be threaded into a corresponding nut (e.g., nut 450), which may secure the fastener 400*a* and the clamping member to the base body of the cutting tool assembly.

In some embodiments, the fastener 400*a* may include a head or base 420*a* connected to and/or integrated with the elongated shaft 410*a* (e.g., the base 420*a* may press against a portion of the clamping member, thereby securing the clamping member to the base body of the cutting tool assembly. For example, the base 420*a* may include a tapered portion 421*a*. As described below in more detail, the clamping member may include a corresponding tapered recess, which may accept the fastener 400*a*. Accordingly, respective tapers of the recess and the fastener 400*a* may locate the fastener 400*a* and the clamping member relative to each other (e.g., when the fastener 400*a* and the clamping members are fastened to the base body of the cutting tool assembly).

As described above, the fastener 400*a* may include the cutting elements 210*d*. For example, the cutting element 210*d* may be attached to (e.g., brazed, welded, fastened, etc.) and/or incorporated with the base 420*a*. In an embodiment, the cutting element 210*d* may include a superhard table 212*d* bonded to a substrate 213*d*. Moreover, the superhard table 212*d* may define a working surface 211*d* of the cutting element 210*d*. For example, when the fastener 400*a* is positioned in the opening of the clamping member and/or fastens the clamping member to the base body of the cutting tool assembly, a portion of or the entire substrate 213*d* of the cutting element 210*d* may be located in the counterbore of the clamping member, and the working surface 211*d* may be exposed. In some embodiments, the superhard table 212*d* may extend past the upper surface of the clamping member to facilitate engagement of the working surface 211*d* with the target material.

Figure 5:
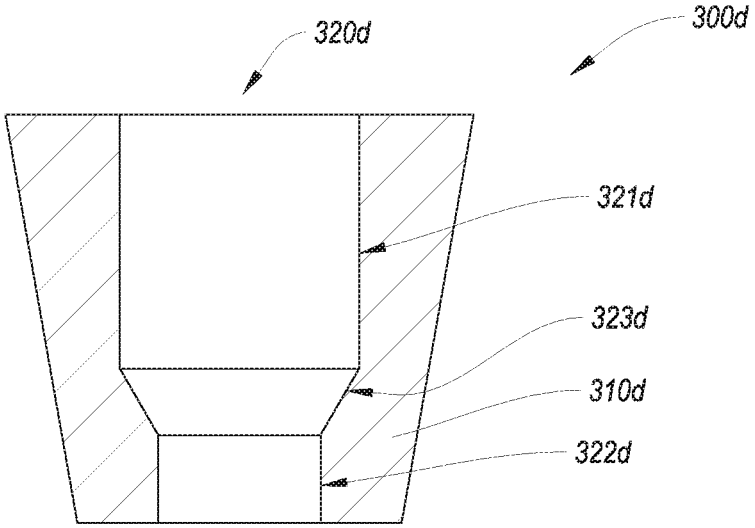
FIG. 5 is an isometric cutaway view of a clamping member according to an embodiment.

FIG. 5 illustrates a clamping member 300*d* according to an embodiment. In particular, in the illustrated embodiment, the clamping member 300*d* has a clamp body 310*d* and an recess 320*d* extending therethrough. Except as described herein, the clamping member 300*d* and its materials, elements, components, or features may be similar to or the same as any of the clamping members 300, 300*c* (FIGS. 1A-1B, 3A-3B) and their corresponding materials, elements, components, and features.

As mentioned above, the recess 320*d* may include a counterbore 321*d* that may facilitate a base of a fastener inserted into the recess 320*d*. Moreover, a lower portion 322*d* of the recess 320*d* may have a smaller cross-sectional area than the counterbore 321*d* (e.g., the lower portion 322*d* of the recess 320*d* may have a smaller inside diameter then the counterbore 321*d* of the recess 320*d*). For example, the recess 320*d* may include a step or a landing between the counterbore 321*d* and the lower portion 322*d* against which the base of the fastener may contact to fasten the clamping member 300*d* to the base body of the cutting tool assembly.

In some embodiments, the step or landing between the counterbore 321*d* and lower portion 322*d* of the recess 320*d* may be at least partially tapered and/or may form a tapered portion 323*d*. For example, the tapered portion 323*d* may transition from the diameter of the counterbore 321*d* to the diameter of the lower portion 322*d* of the recess 320*d*. Furthermore, as described above, the fastener may include a tapered surface on the base thereof, which may have a similar or the same angle as the tapered portion 323*d*. In an embodiment, when the tapered surface of the fastener is pressed against the tapered portion 323*d*, a centerline of the fastener may be aligned with a centerline of the recess 320*d*, thereby aligning the fastener and the clamping member 300*d* relative to each other and/or relative to the base body of the cutting tool assembly (e.g., relative to a threaded hole on the base body).

Figure 6:
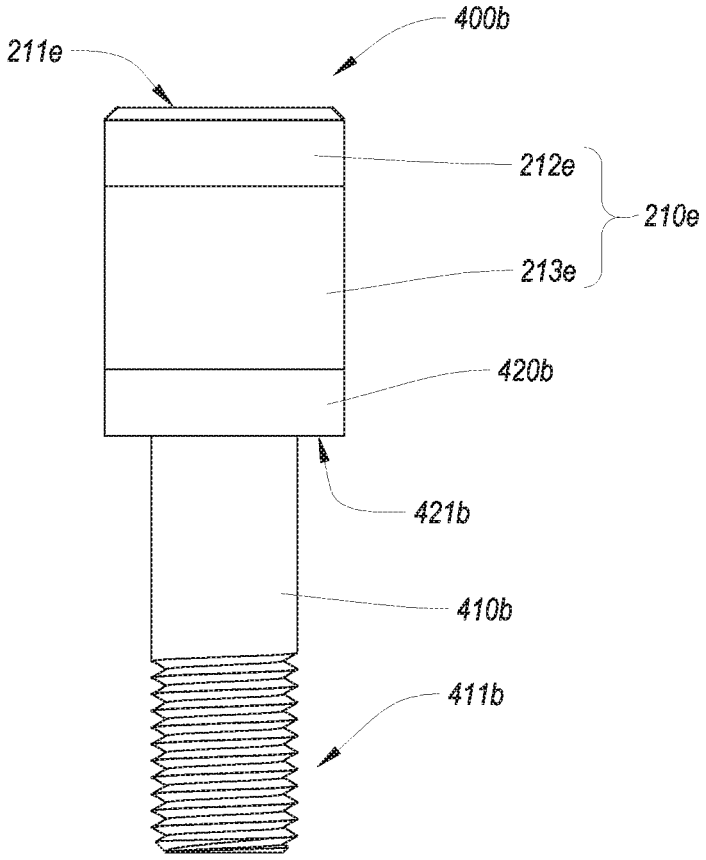
FIG. 6 is a side view of a fastener with a cutting element according to an embodiment.

In some embodiments, the fastener may have a step or a landing between the base and the elongated shaft, which may be generally flat and perpendicular to the elongated shaft of the fastener. FIG. 6 illustrates a fastener 400*b* that includes a cutting element 210*e* attached to or integrated with an elongated shaft 410*b*, according to an embodiment. Except as otherwise described herein, the fastener 400*b* and its materials, components, elements, or features may be the same as or similar to any of the fasteners 400, 400*a* (FIGS. 1A, 4) and their corresponding materials, components, elements, and features. For example, the elongated shaft 410*b* of the fastener 400*b* may include a male thread 411*b*, which may be similar to or the same as the male thread 411*a* of the fastener 400*a* (FIG. 4).

The fastener 400*b* may include a base 420*b* attached to or integrated with the elongated shaft 410*b*. In an embodiment, the base 420*b* may define a step 421*b* that may extend outward from the peripheral surface of the elongated shaft 410*b*. When the fastener 400*b* is fastened to the base body of the cutting tool assembly, the step 421*b* of the base 420*b* may abut against at least a portion of the clamping member, thereby fastening or securing the clamping member to the base body. For example, the step 421*b* may abut against a bottom surface of a counterbore in the clamping member.

As described above, the cutting element 210*e* may include a superhard table 212*e* that may be bonded to a substrate 213*e*. In an embodiment, the superhard table 212 may define a working surface 211*e* that may be generally planar or flat. As shown in FIG. 6, at least a portion of the working surface 211*e* may be defined by a chamfer or a fillet that may extend between the working surface 211*e* and at least a portion of the peripheral surface of the superhard table 212*e*. Alternatively, the perimeter of working surface 211*e* may be defined by a generally sharp edge formed between the working surface 211*e* and the peripheral surface of the superhard table 212*e*.

Figure 7:
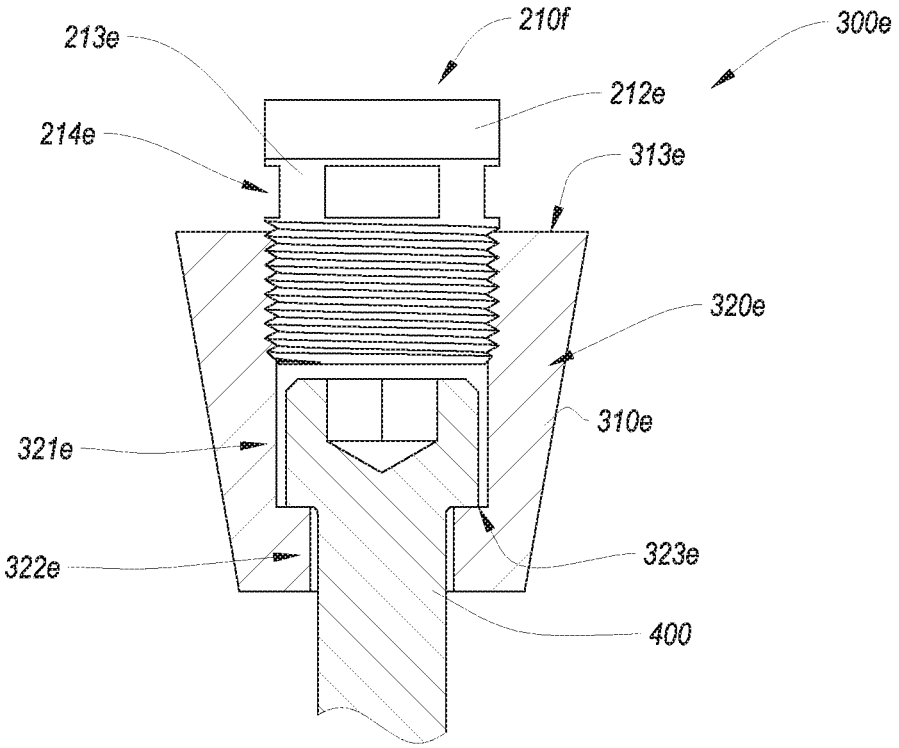
FIG. 7 is a cross-sectional view of a clamping member and a fastener according to an embodiment.

In some embodiments, one or more cutting elements may be mounted and/or secured to the clamping member separately from the fastener(s) that may fasten the clamping member to the base body of the cutting tool assembly. FIG. 7 illustrates a clamping member 300*e* and a cutting element 210*f* attached thereto according to an embodiment. Except as described herein, the clamping member 300*e* and its materials, elements, components, or features may be similar to or the same as any of the clamping members 300, 300*c*, 300*d* (FIGS. 1A-1B, 3A-3B, 5) and their corresponding materials, elements, components, and features.

For example, a clamp body 310*e* of the clamping member 300*e* may include a recess 320*e*, which may be defined by a counterbore 321*e* and a lower portion 322*e* of the recess 320*e*, which collectively may accommodate a fastener (e.g., fastener 400) therein in a manner that may secure the clamping member 300*e* to the base body of the cutting tool assembly. Generally, the counterbore 321*e* may extend between a flange surface 323*e* and an upper surface 313*e* of the clamping member 300*e*. In the illustrated embodiment, at least a portion of the counterbore 321*e* may include a female thread that may accommodate a male threaded member therein. In some embodiments, at least a portion of the cutting element 210*f* may be configured as a male thread that may be engage or thread into the female thread in the counterbore 321*e*.

More specifically, for example, the cutting elements 210*f* may include a superhard table 212*e* bonded to a substrate 213*e* that may have a male thread formed on a portion thereof. As described above, the substrate 213*e* may include carbide or a similar material. In some embodiments, the substrate 213*e* may include or comprise steel, other metallic materials, etc. In any event, the substrate 213*e* may include any number of suitable materials, which may vary from one embodiment to the next.

In an embodiment, the substrate 213*e* may include one or more installation features, such as flats 214*e* (not all labeled), which may accommodate a tool for installing or removing cutting element 210*f* (e.g., a wrench, a screw driver, a hexagonal drive shaft, etc.). As such, for example, the substrate 213*e* may be unscrewed from the clamping member 300*e* to provide access to the fastener 400. Under some operating conditions, the cutting element 210*f* may be rotated and removed from the clamping members 300*e* to access and rotate the fastener 400, thereby unfastening the clamping member 300*e* from the base body. Subsequently, as described above, the clamping member 300*e* may be replaced with another clamping member. Additionally or alternatively, the cutting element 210*f* may be rotated and replaced with another cutting element.

Figure 8:
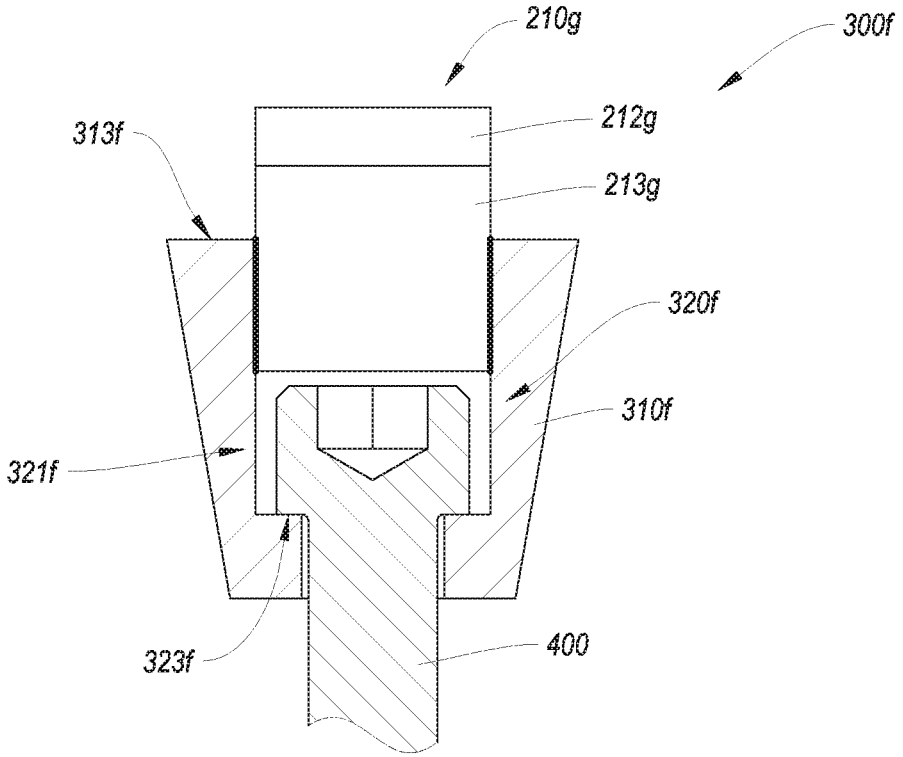
FIG. 8 is a cross-sectional view of a clamping member and a fastener according to another embodiment.

In some embodiments, the cutting element may be brazed to the clamping member in a manner that covers or conceals the fastener that fastens the clamping member to the base body of the cutting tool assembly. FIG. 8 illustrates a clamping member 300*f* and a cutting element 210*g* brazed to the clamping member 300*f* according to an embodiment. Except as described herein, the clamping member 300*f* and its materials, elements, components, or features may be similar to or the same as any of the clamping members 300, 300*c*, 300*d*, 300*e* (FIGS. 1A-1B, 3A-3B, 5, 7) and their corresponding materials, elements, components, and features.

For example, a clamp body 310*f* of the clamping member 300*f* may include an recess 320*f* that may be similar to or the same as the recess 320 of the clamping member 300 (FIG. 1A). In an embodiment, the recess 320*f* may include a counterbore 321*f* that may extend from a bottom 323*f* to an upper surface 313*f* of the clamp body 310*f*. As described above, the head or base of the fastener 400 may press against the flange surface 323*f* of the recess 320*f* to secure the clamping member 300*f* to the base body of the cutting tool assembly.

In some embodiments, the cutting element 210*g* may be positioned at least partially within the counterbore 321*f*. For example, the cutting elements 210*g* may include superhard table 212*g* bonded to a substrate 213*g*, which may be positioned at least partially within and/or secured within the counterbore 321*f* in the clamp body 310*f* of the clamping member 300*f*. In at least one embodiment, the substrate 213*g* may be brazed to the clamping member 300*f* within the 324*f*. Additionally or alternatively, the substrate 213*g* may be press-fit, welded, or otherwise secured and/or bonded to the clamping member 300*f*.

Figure 9A:
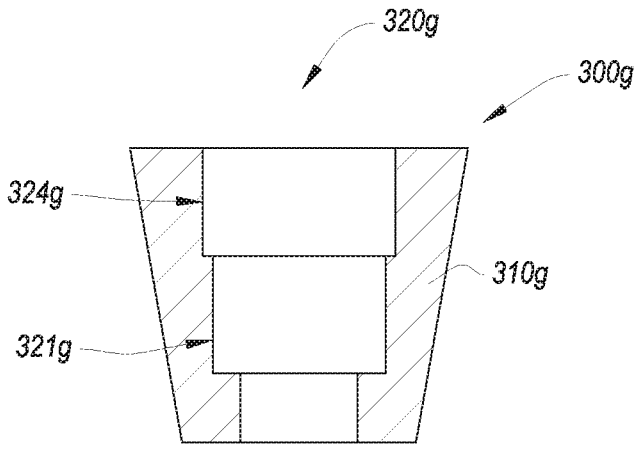
FIG. 9A is a cross-sectional view of a clamping member according to yet another embodiment.
Figure 9B:
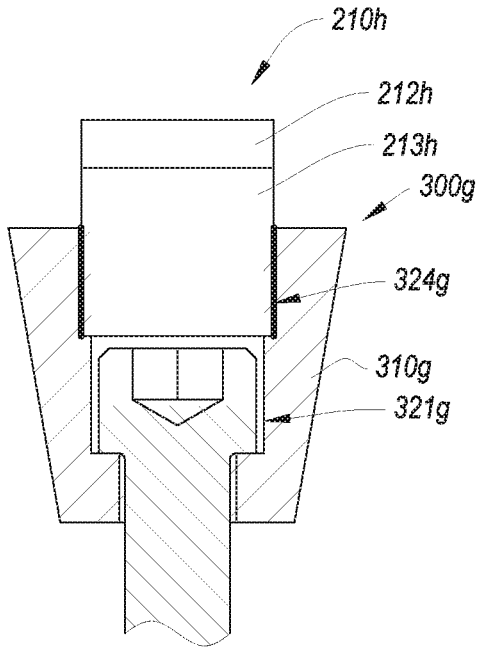
FIG. 9B is a cross-sectional view of the clamping member of FIG. 9A and a fastener according to an embodiment.

Moreover, in some embodiments, the recess in the clamping member may include a step that may prevent the cutting element from abutting the head or base of the fastener located in the counterbore. FIGS. 9A-9B respectively illustrate a clamping member 300*g* and a cutting element 210*h* brazed to the clamping member 300*g*, according to one or more embodiments. Except as described herein, the clamping member 300*g* and its materials, elements, components, or features may be similar to or the same as any of the clamping members 300, 300*c*, 300*d*, 300*e*, 300*f* (FIGS. 1A-1B, 3A-3B, 5, 7, 8) and their corresponding materials, elements, components, and features.

For example, a clamp body 310*g* of the clamping member 300*g* may include an recess 320*g* that may be similar to the recess 320*f* of the clamping member 300*f* (FIG. 8). In an embodiment, the recess 320*g* may include a lower counterbore portion 321*g* and an upper counterbore portion 324*g*. In particular, for example, the upper counterbore portion 324*g* may have a greater cross-sectional area then the lower counterbore portion 321*g*, thereby forming a step therebetween.

In some embodiments, the cutting element 210*h* may be positioned at least partially within into the upper counterbore portion 324*f* and may be secured therein. Moreover, for example, a bottom of the cutting element 210*h* may be positioned on or near the step formed between the upper counterbore portion 324*g* and the lower counterbore portion 321*g*. For example, the cutting elements 210*h* may include a superhard table 212*h* bonded to a substrate 213*h*, and a portion of the substrate 213*h* may be placed or positioned on or near the step formed between the upper counterbore portion 324*g* and the lower counterbore portion 321*g*. In at least one embodiment, the substrate 213*h* may be brazed to the clamping member 300*g* within the upper counterbore portion 324*g*. Additionally or alternatively, at least a portion of the substrate 213*h* of the cutting element 210*h* may be press-fit, welded, or otherwise secured to and/or within the upper counterbore portion 324*g*.

Figure 10A:
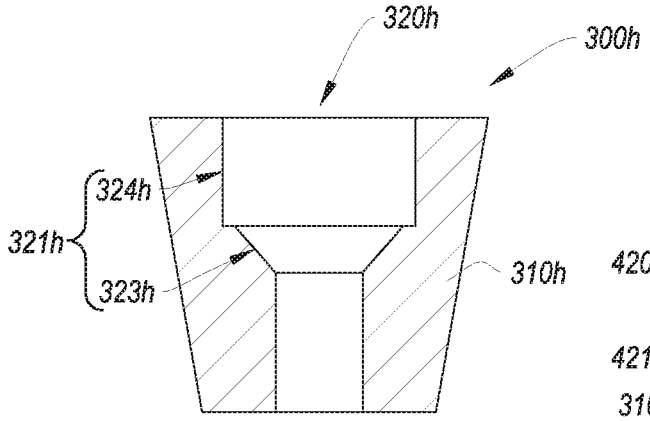
FIG. 10A is a cross-sectional view of a clamping member according to an embodiment.
Figure 10B:
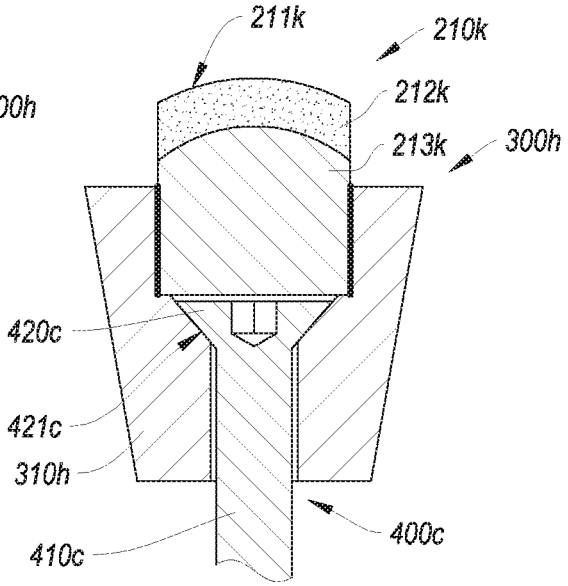
FIG. 10B is a cross-sectional view of the clamping member of FIG. 10A and a fastener according to an embodiment.

As described above, in some embodiments, the recess in the body of the clamping member and the corresponding fastener may include a tapered portion that may locate the fastener and the clamping member relative to each other. FIGS. 10A-10B respectively illustrates a clamping member 300*h* and a cutting element 210*k* brazed to the clamping member 300*h*, according to one or more embodiments. Except as described herein, the clamping member 300*h* and its materials, elements, components, or features may be similar to or the same as any of the clamping members 300, 300*c*, 300*d*, 300*e*, 300*f*, 300*g* (FIGS. 1A-1B, 3A-3B, 5, 7-9B) and their corresponding materials, elements, components, and features.

In an embodiment, a clamp body 310*h* of the clamping members 300*h* may include an recess 320*h* sized and configured to accept a fastener 400*c* with a tapered head or base 420*c* (e.g., a flat head screw, such as a flat head cap screw). More specifically, for example, the recess 320*h* may include a counterbore 321*h* with a tapered portion 323*h*. For example, the counterbore 321*h* may include a generally cylindrical upper portion 324*h* and a tapered portion 323*h*. In some embodiments, the counterbore 321*h* may include a step or flange surface formed between the upper portion 324*h* and the tapered portion 323*h*.

Correspondingly, the base 420*c* of the fastener 400*c* may include a tapered portion 421*c*, which may have the same or similar angle as the tapered portion 323*h* of the counterbore 321*h*. Accordingly, for example, when the fastener 400*c* fastens the clamping member 300*h* to the base body, the corresponding and/or matching tapered portion 421*c* of the fasteners 400 and the tapered portion 323*h* of the counterbore 321*h* may help align the clamping member 300*h* and the fastener 400*c* relative to each other. In some embodiments, such alignment also may align the clamping members 300*h* relative to the base body of the cutting tool assembly (e.g., relative to a threaded hole in the base body).

As described above, the cutting element 210*k* may be attached or secured to the clamp body 310*h* of the clamping member 300*h*. For example, the cutting element 210*k* may be brazed in the upper portion 324*h* of the counterbore 321*h*. In particular, for example, a bottom of the cutting element 210*k* may be positioned near and/or may abut the step formed between the upper portion 324*h* and the tapered portion 323*h* of the counterbore 321*h*. In an embodiment, the cutting elements 210*k* may be brazed or otherwise secured within the upper portion 324*h*.

Generally, any suitable cutting element may be attached or secured to any of the clamping members described herein. As described above, the cutting elements 210*k* may include superhard table 212*k* bonded to substrate 213*k*. Furthermore, the superhard table 212*k* may define a working surface 211*k*. In some embodiments, the working surface 211*k* may be pointed, generally arcuate, or dome-shaped.

Figure 11:
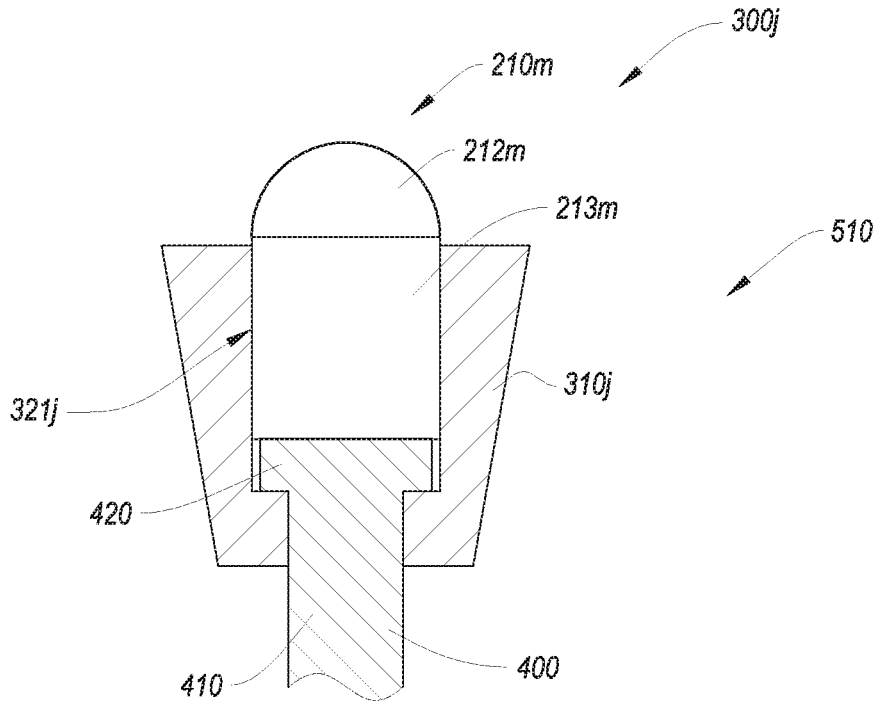
FIG. 11 is a cross-sectional view of a clamping member and a fastener according to an embodiment.

As mentioned above, in some embodiments, the cutting elements may be press-fit into the clamp body. FIG. 11 illustrates a clamping member 300*j* that includes a cutting element 210*m* press-fit into a clamp body 310*j* (the clamping member 300*j* is illustrated as cross-sectioned, and the cutting element 210*m* is shown without cross-section therethrough). Except as described herein, the clamping member 300*j* and its materials, elements, components, or features may be similar to or the same as any of the clamping members 300, 300*c*, 300*d*, 300*e*, 300*f*, 300*g*, 300*h* (FIGS. 1A-1B, 3A-3B, 5, 7-10B) and their corresponding materials, elements, components, and features. For example, the outer shape of the clamp body 310*j* may be similar to or the same as the outer shape of the clamp body 310*g* (FIGS. 9A-9B).

Generally, the cutting element 210*m* may include a superhard table 212*m* bonded to a substrate 213*m*. In an embodiment, the superhard table 212*m* may define a generally semi-spherical working surface. As described above, however, the superhard table 212*m* may define any number of suitable surface shapes that may vary from one embodiment to the next.

In the illustrated embodiment, the cutting element 210*m* is press-fit into the clamp body 310*j*. However, the substrate 213*m* of the cutting element 210*m* may be press-fit, brazed, or otherwise attached within a counterbore 321*j*. In an embodiment, the clamping member 300*j* may be secured to a base body of a cutting tool assembly with the fastener 400. Generally, the fastener 400 may include an elongated shaft 410 and a head 420 attached to or integrated with the shaft 410. For example, the head 420 of the fastener 400 may be sized and configured to fit in the counterbore 321*j*.

Furthermore, the bottom of the substrate 213*m* of the cutting element 210*m* may rest or may be positioned (e.g., may abut) a top of the head 420 of the fastener 400. For example, the top of the head 420 may provide support for the cutting element 210*j*, such as to prevent or limit movement of the cutting element inward into the counterbore 321*j* during operation. In some embodiments, positioning the bottom of the substrate 213*m* on the top of the head 420 may position the superhard table 212*m* and the working surface thereof at a predetermined location relative to a top of the clamp body 310*j*.

In some embodiments, the elongated shaft 410 may extend through the clamp body 310*j* (e.g., through an opening or hole in the clamp body 310*j*). In an embodiment, the shaft 420 may be press-fit in the clamp body 310*j* (e.g., in the hole in the clamp body 310*j*). For example, press-fit between the fastener 400 and the clamp body 310*j* may prevent or impede the fastener 400 from rotating relative to the clamp body 310*j*.

Figure 12A:
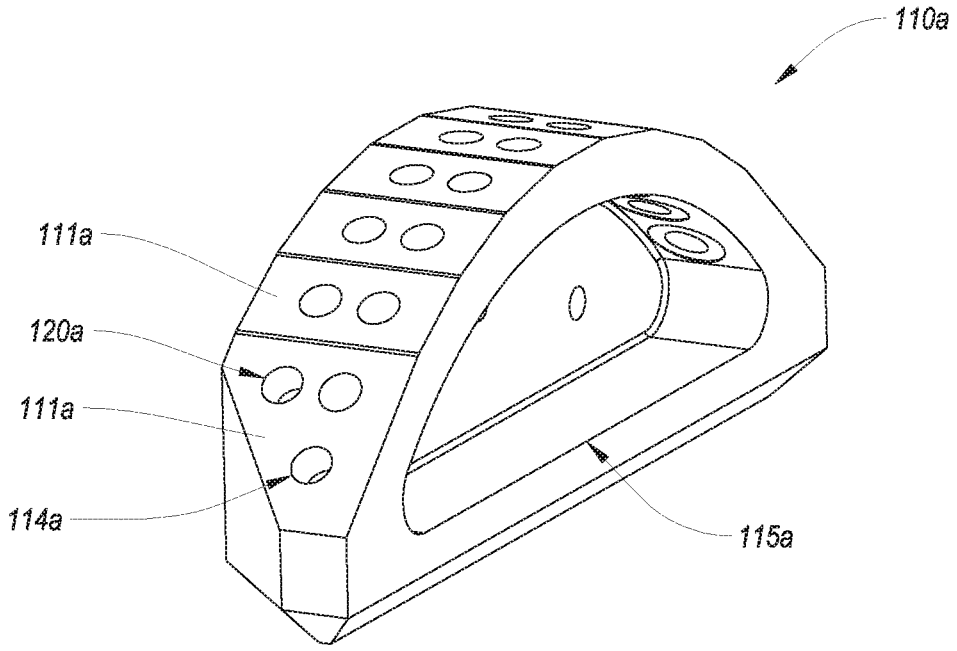
FIG. 12A is a back isometric view of a base body according to an embodiment.

It should be appreciated that, generally, the base body of the cutting tool assembly may vary from one embodiment to the next. Moreover, the cutting tools mounted or secured to the base body also may vary from one embodiment to the next (e.g., configuration of the positioning features of the cutting tools may conform to corresponding configurations of the positioning features on the base body). FIG. 12A illustrates a base body 110*a* of a cutting tool assembly according to an embodiment. Except as otherwise described herein, the base body 110*a* and its materials, components, elements, or features may be similar to or the same as the base body 110 (FIGS. 1A-1B) and its corresponding materials, components, elements, and features. For example, the base body 110*a* may have the same or similar general shape as the base body 110 (FIGS. 1A-1B).

In an embodiment, the base body 110*a* may include upper surfaces 111*a* (not all labeled) collectively positioned and arranged along a curved line. As described below in more detail, cutting tools may be positioned and/or secured to the base body 110*a* at corresponding upper surfaces 111*a* thereof. In some embodiments, the base body 110*a* may include tool positioning features 120*a* (not all labeled) positioned along the upper surfaces 111*a* (e.g., at least one positioning feature 120*a* may be located at or on one, some, or each of the upper surfaces 111*a*). In some embodiments, one, some, or all of the tool positioning features 120*a* may be formed or defined by one or more positioning holes configured to accept a positioning member (e.g., a dowel pin or a fastener) that may locate and/or orient corresponding cutting tools on the base body 110*a*.

Additionally or alternatively, the base body 110*a* may include mounting holes 114*a* (not all labeled), for mounting the cutting elements to the base body 110*a*. As described below in more detail, fasteners may pass through the mounting holes 114*a* to secure the corresponding cutting elements to the base body 110*a*. In some embodiments, the base body 110*a* includes a pocket 115*a*. For example, a portion of the fastener may be positioned within the pocket 115*a* and a nut may be threaded onto a portion of the fastener, thereby securing the fastener to the cutting tool to the base body 110*a*. Alternatively, the mounting holes 114*a* may include a female thread, and a corresponding fastener may be threaded into the female thread of the mounting holes 114*a*, thereby securing the cutting element to the base body 110*a*.

Figure 12B:
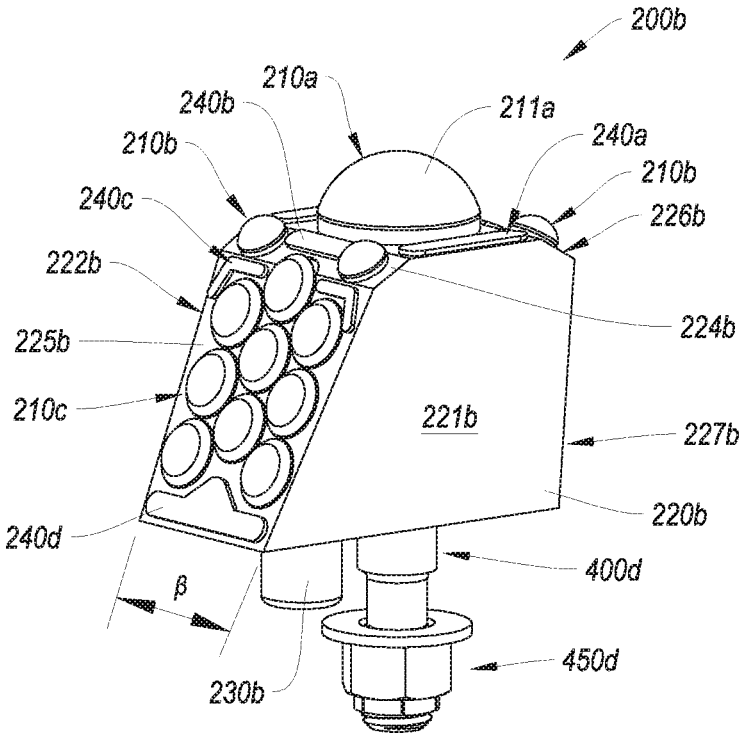
FIG. 12B is an isometric view of a cutting tool according to an embodiment.
Figure 12C:
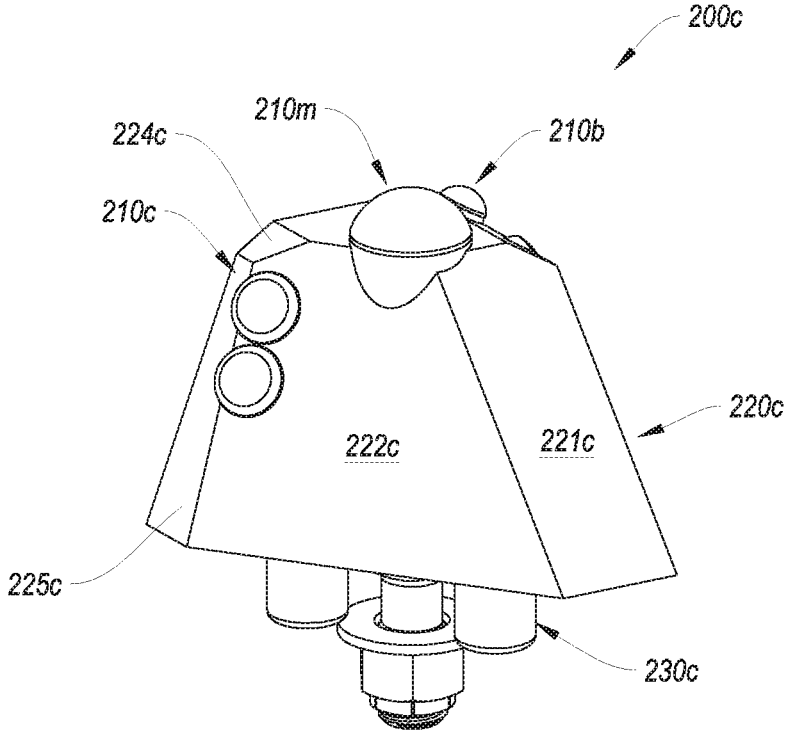
FIG. 12C is an isometric view of a cutting tool according to an embodiment.

FIGS. 12B-12C illustrate cutting tools 200*b*, 200*c*, respectively, which may be secured to the base body 110*a* (FIG. 12A), according to one or more embodiments. Except as otherwise described herein, the cutting tools 200*b* and/or 200*c*, and their corresponding materials, components, elements, or features may be similar to or the same as the cutting tool 200 (FIGS. 1A-2B) and its corresponding materials, components, elements, and features. As shown in FIG. 12B, the cutting tool 200*b* may include a cutting tool body 220*b* and cutting elements 210*a*, 210*b*, 210*c* secured to the cutting tool body 220*b*.

For example, the cutting tool body 220*b* may have the same general shape as the cutting tool body 220 (FIGS. 1A-2B). Further, the cutting element 210*a* may be secured to the cutting tool body 220*b* and may extend beyond an upper surface of the cutting tool body 220*b*, such that the working surface 211*a* is exposed to facilitate engagement with the target material during. Moreover, the cutting elements 210*b* may be secured to the cutting tool body 220*b* and may extend beyond a slanted surface 224*b* of the cutting tool body 220*b*. In an embodiment, the cutting elements 210*c* may be secured to the cutting tool body 220*b* and extend beyond a slanted surface 225*b* of the cutting tool body 220*b*. In at least one embodiment, the upper surface, the slanted surface 224*b*, and the slanted surface 225*b* may have the same or similar sizes and relationships to one another as the upper surface 223, slanted surface 224, slanted surface 225 of the cutting tool body 220 (FIG. 2A).

In an embodiment, the cutting tools 200*b* may include one or more shielding elements, such as shielding elements 240*a*, 240*b*, 240*c*, 240*d* (not all labeled). For example, the shielding elements 240*a*, 240*b*, 240*c*, 240*d* may protect or shield spaces between and/or adjacent the cutting elements 210*a*, 210*b*, 210*c*, or combinations thereof, such as to protect the surfaces of the cutting tool body 220*b* (e.g., the upper surface, the slanted surfaces 224*b*, 225*b*, etc.). As such, in some embodiments, the shielding elements 240*a*, 240*b*, 240*c*, 240*d* may have any number of suitable shapes and/or sizes, which may, for example, depend on the shapes, sizes, and arrangement of the cutting elements 210*a*, 210*b*, 210*c*.

For example, shielding elements 240*a* may have a generally rectangular surface shape or an elongated surface shape to protect the upper surface near the cutting elements 210*a*. The shielding elements 240*b* may have a generally rectangular surface shape or an elongated surface shape to protect the slanted surface 224*b* between the cutting elements 210*b*. In an embodiment, the shielding elements 240*c* may have a generally angled surface shape that may at least partially surround at least one of the cutting elements 210*c* adjacent to the corresponding shielding element 240*c*.

In some embodiments, the shielding element 240*d* may include a generally rectangular surface portion and a triangular surface portion extending from a major side of the rectangular surface portion. In particular, for example, the triangular surface portion of the 240*d* may extend between at least two of the cutting elements 210*c*. In some embodiments, surfaces 226*b* and/or 227*b* of the cutting tool body 220*b* may have generally the same sizes and/or configurations and the surfaces 226, 227 of the cutting tool body 220 (FIG. 2B). For example, the cutting tool 200*b* may include cutting elements 210*b* secured to the cutting tool body 220*b* and extending beyond the surface 226*b* of the cutting tool body 220*b*.

In some embodiments, sidewalls 221*b* and 222*b* may define or form an angle β therebetween. Generally, the angle β may be any suitable angle, which may vary from one embodiment to the next. In one or more embodiments, the angle β may be a relatively small angle (e.g., less than 5° included angle, less than 10° included angle. or a 3° included angle). Alternatively, the angle β may be a relatively large angle (e.g., greater than 10° included angle or a 30° included angle). For example, the angle β may be such that abutting adjacent cutting tools 200*b* (e.g., such that sidewalls of the adjacent abutting cutting tools 200*b* are in contact with each other) may position the cutting tools 200*b* along a generally curved upper side of the base body of the cutting tool assembly.

In some embodiments, the cutting tool 200*b* may include a positioning member 230*b*, which may position and/or orient the cutting tool 200*b* on the base body of the cutting tool assembly. In particular, for example, the positioning member 230*b* may be a dowel pin extending outward from a bottom surface of the cutting tool body 220*b*. In some embodiments, the positioning member 230*b* may be attached or secured to the cutting tool body 220*b* (e.g., the cutting tool body 220*b* may include an opening and the positioning member 230*b* may be secured within the opening). Alternatively, the positioning member 230*b* may be integrated with the cutting tool body 220*b*.

In at least one embodiment, a fastener may be integrated with or attached to the cutting tool body 220*b*. For example, a fastener 400*d* may be secured to the cutting tool body 220*b*. As described below in more detail, the fastener 400*d* may be inserted into an opening in the base body, and a nut 450*d* may be threaded onto a threaded end of the fasteners 400*d*, thereby securing the fasteners 400*d* together with the cutting tool body 220*b* to the base body.

FIG. 12C illustrates a cutting tool 200*c* according to an embodiment. As described below in more detail, the cutting tool 200*c* may be positioned at an end region (e.g., at an end) of a row of cutting tools 200*b* (FIGS. 12D-12E)). As such, in some embodiments, after securing the cutting tool 200*c* to the base body of the cutting tool assembly, one or more surfaces of the cutting tool 200*c* may coincide and/or may be coplanar with or may extend from corresponding surfaces of the base body. Moreover, for example, one or more surfaces of the cutting tool 200*c* may coincide and/or may be coplanar with or may extend from corresponding surface(s) of adjacent cutting tools, such as cutting tools 200*b* (FIGS. 12D-12E), as described below.

For example, the cutting tool 200*c* may include a cutting tool body 220*c* defined by at least by peripheral sidewalls 221*c*, 222*c* and slanted surfaces 224*c*, 225*c*. In some embodiments, when the cutting tool 200*c* is mounted to the base body of the cutting tool assembly, the sidewalls 221*c*, 222*c* and/or the slanted surfaces 224*c*, 225*c* may extend from or to surfaces of the adjacent cutting tools and/or of the base body, as described below.

Moreover, in an embodiment, the cutting tool 200*c* may include cutting elements 210*b*, 210*c*, 210*m* secured thereto and may extend beyond the sidewalls of the cutting tool body 220*c* (e.g., the cutting elements 210*c* may extend outward and/or beyond the sidewall 222*c* and the slanted surface 225*c*). In an embodiment, the cutting element 210*m* may be similar to the cutting elements 210*a* (FIG. 2A). For example, the cutting elements 210*m* may have a dome-shaped or generally semi-spherical working surface defined by a superhard table. In some embodiments, the cutting element 210*m* may be secured to the cutting tool body 220*c* and extend outward beyond an upper surface of the cutting tool body 220*c*.

Figure 12D:
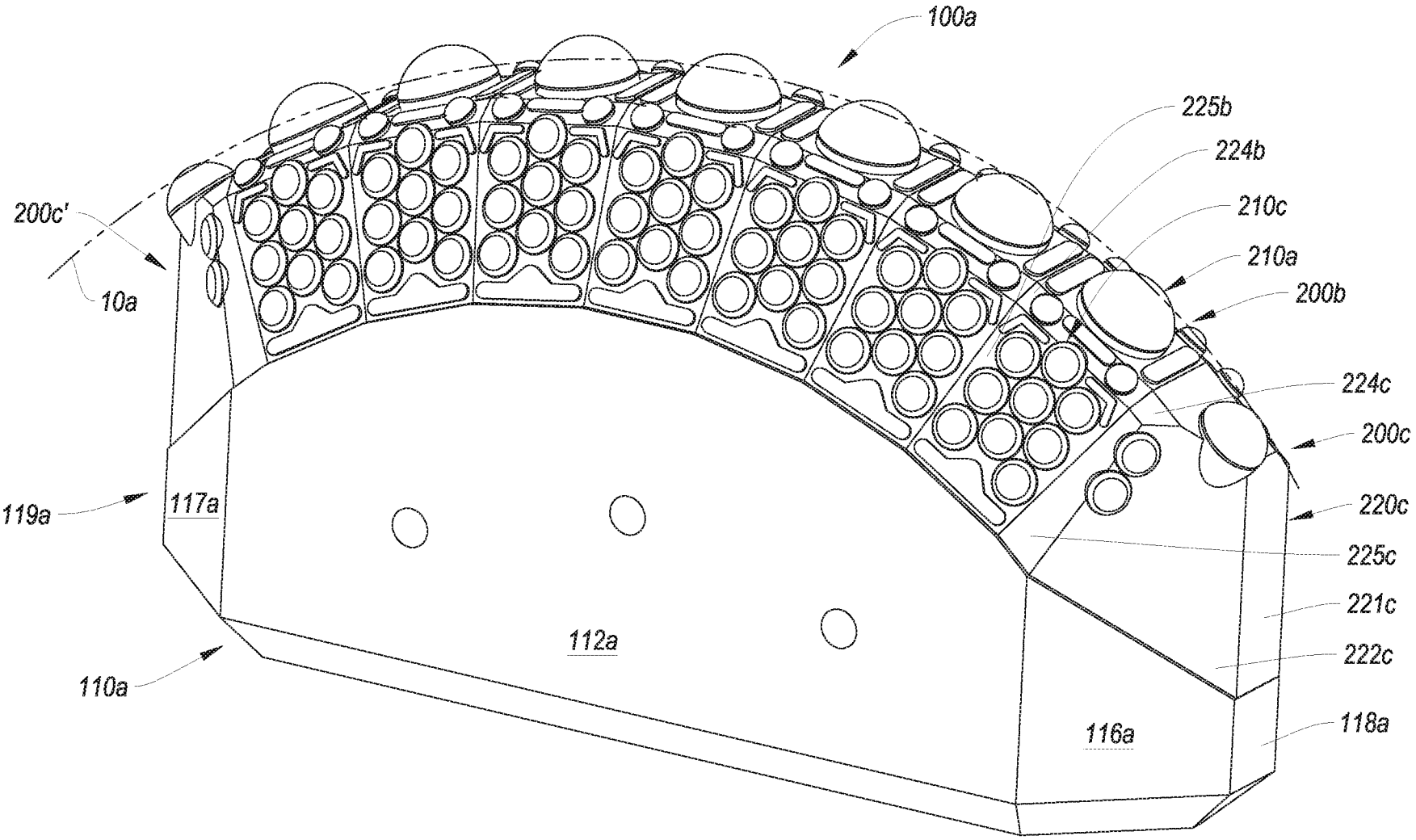
FIG. 12D is a front isometric view of a cutting tool assembly according to an embodiment.
Figure 12E:
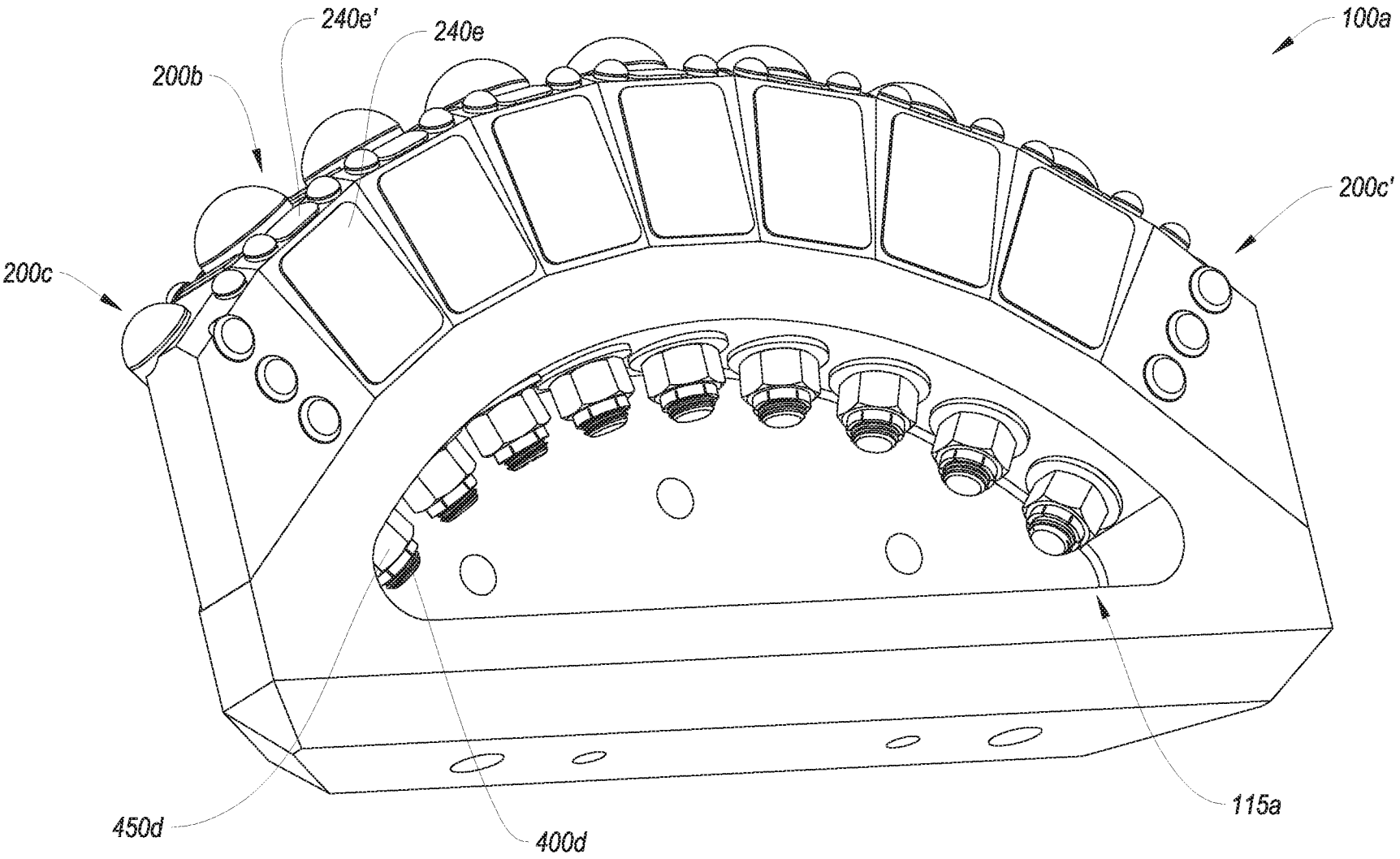
FIG. 12E is a back isometric view of the cutting tool assembly of FIG. 12D.

As mentioned above, one or more cutting tools 200*b* (FIG. 12B) and one or more cutting tools 200*c* may be mounted and/or secured to a base body of a cutting tool assembly. In an embodiment, as shown in FIG. 12D, when the cutting tools 200*c* and the cutting tools 200*b* are mounted and/or secured to the base body base body 110*a*, the slanted surface 225*c* of the cutting tool 200*c* may be coplanar with and/or extend from the slanted surface 225*b* of the adjacent cutting tool 200*b* (e.g., the cutting tools 200*c* may be mounted at an end region the base body 110*a*). Similarly, the slanted surface 224*c* of the cutting tool 200*c* may extend from and/or may be coplanar with the slanted surface 224*b* of the adjacent cutting tool 200*b*.

Mounting the cutting tools 200*b* (not all labeled) and cutting tools 200*c* (not all labeled) on the base body 110*a* may generally form a cutting tool assembly 100*a*, as shown in FIG. 12D. Except as described herein, the cutting tool assembly 100*a* and its materials, components, elements or features may be the same as or similar to the cutting tool assembly 100 (FIGS. 1A-1B) and its corresponding materials, components, elements and features. In the illustrated embodiment, the cutting tool assembly 100*a* also includes a cutting tool 200*c*', which may be mounted and/or secured to the base body 110*a* at an end thereof. In an embodiment, the cutting tool 200*c*' may be a mirror image of the cutting tools 200*c*. It should be appreciated that the designation of "end regions" of the base body 110*a* are used for descriptive purposes only, to identify longitudinal ends of the base body 110*a* in the view illustrated in FIG. 12D. Accordingly, such designations should not be considered as limiting in any way.

For example, when the cutting tools 200*b*, 200*c*, 200*c*' are mounted and/or secured to base body 110*a*, the cutting tools 200*b*, 200*c*, 200*c*' may be aligned along a generally arcuate path (e.g., along a curved reference line 10*a*). Moreover, in some embodiments, the cutting tool assembly 100*a* may include a rake angle formed by the cutting elements 210*c* and/or slanted surfaces 224*b*, 225*b* of the cutting tools 200*b* and/or at least in part by the slanted surface 224*c*, 225*c* of the cutting tools 200*c* and corresponding surfaces of the cutting tools 200*c*'. For example, during operation, failed material may move away from the cutting elements 210*a* of the cutting tools 200*b* along the rake angle of the cutting tool assembly 100*a*.

In an embodiment, the base body 110*a* may include a front surface 112*a* and slanted surfaces 116*a*, 117*a* extending therefrom and to respective end surfaces 118*a*, 119*a* of the base body 110*a*. The sidewall 222*c* of the cutting tool body 220*c* of the cutting tools 200*c* may extend from and/or may be coplanar with the slanted surface 116*a* of the base body 110*a*. Further, the sidewall 221*c* of the cutting tool body 220*c* of the cutting tools 200*c* may extend from and/or may be coplanar with the end surface 118*a* of the base body 110*a*. As noted above, the cutting tool 200*c*' may be a mirror image of the cutting tools 200*c*. Accordingly, in some embodiments, the cutting tool 200*c*' may include corresponding surfaces that may extend from and/or may be coplanar with the slanted surface 117*a* and/or end surface 119*a* of the base body 110*a*.

As described above and as shown in FIG. 12E, the cutting tools 200*b*, 200*c*, 200*c*' may be secured to the base body 110*a* with corresponding fasteners 400*d* and nuts 450*d* (not all labeled), such that, for example, the bottoms of the cutting tools 200*b*, 200*c*, 200*c*' are positioned on corresponding upper surfaces of the base body 110*a*. In an embodiment, the threaded ends of the fasteners 400*d* may be accessed in the pocket 115*a* of the base body 110*a*, and the nuts 450*d* may be threaded or fastened onto the corresponding fasteners 400*d*, thereby securing the fasteners 400*d* and corresponding cutting tools 200*b*, 200*c*, 200*c*' to the base body 110*a* of the cutting tool assembly 100*a*.

In an embodiment, one, some, or each of the cutting tools 200*b* may include one or more shielding elements (e.g., shielding elements 240*e*, 240*e*'). For example, the shielding elements 240*e*, 240*e*' may protect corresponding one or more selected surface(s) of the cutting tool bodies of the cutting tools 200*b*. The shielding elements 240*e*, 240*e*' may be sized and/or shaped to cover at least some or most of the selected surface(s) of corresponding cutting tools 200*b*. Alternatively, as described above, the one, some, or all of the selected surface(s) may include cutting elements, shielding or protective coating(s), such as hardfacing (including laser hardfacing), HVOF coating, shielding elements, or combination of the foregoing (e.g., as described above in connection with FIGS. 2A-2B). In any event, the selected surfaces of the cutting tools 200*b*, 200*c*, 200*c*' may be configured to have suitable resistance to abrasion and/or wear during operation of the cutting tool assembly 100*a*.

Embodiments of the invention generally relate to tunnel boring machine cutting tool assemblies, such as ripping and scraping cutting tool assemblies, and related methods of use and manufacturing. The various embodiments of the cutter assemblies described herein may be used in TBMs, EPBs, raise drilling systems, large diameter blind drilling systems, and other types of mechanical drilling and excavation or material-removal systems. In some embodiments, the cutting tool assemblies may include multiple superhard cutter elements that may engage, disrupt, and fail target material. In particular, such superhard cutter elements may exhibit a relatively high wear resistance, which may increase the useful life of the cutter assemblies (as compared with conventional cutter assemblies, such as conventional rippers and scrapers).

FIG. 13 is an isometric view of a schematically illustrated material-removal system 500, according to an embodiment. In particular, the material-removal system 500 may include a cutterhead 510 that may be rotatable about a rotation axis (as indicated with an arrow). For example, the material-removal system 500 may include one or more motors connected to the cutterhead 510 and configured to rotate the cutterhead 510 about the rotation axis. Moreover, the cutterhead 510 may be advanced toward and/or into the target material. For example, the material-removal system 500 may include one or more motors, cylinders (e.g., hydraulic cylinders, pneumatic cylinders), or combinations of the foregoing that may advance the cutterhead 510 toward and into the target material (e.g., the material-removal system 500 may include a stationary portion that may be anchored to a surface, such as to the ground or surrounding material, and the cutterhead 510 may be advanced away from the stationary portion and toward and into the target material).

The material-removal system 500 also may include one or more cutting tool assemblies mounted to the cutterhead 510 (e.g., cutting tool assemblies 100 may be mounted to the cutterhead 510). It should be appreciated that the cutterhead may include any of the cutting tool assemblies described herein. Moreover, in some embodiments, the cutterhead may include any number of additional and/or alternative cutting tools and/or cutting tool assemblies secured thereto.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A cutting tool assembly, comprising:

a base body including a surface mountable to a cutterhead of a material removal machine;

one or more cutting tools secured to the base body, the one or more cutting tools including at least one polycrystalline diamond element having a generally rounded or semispherical surface and at least one polycrystalline diamond element having a generally flat surface; and one or more clamping members secured to the base body, each of the one or more clamping members including a plurality of polycrystalline diamond elements secured thereto.

2. The cutting tool assembly of claim 1, wherein each of the one or more cutting tools includes an upper surface distal to the base body and one or more slanted surfaces, the at least one polycrystalline diamond element having the generally rounded or semispherical surface being positioned on the upper surface and the at least one polycrystalline diamond element having the generally flat surface being positioned on the one or more slanted surfaces.

3. The cutting tool assembly of claim 2, wherein each of the one or more cutting tools includes one or more additional polycrystalline diamond elements having a generally rounded or semispherical surface secured to the one or more slanted surfaces.

4. The cutting tool assembly of claim 1, wherein the plurality of polycrystalline diamond elements secured to each clamping member of the one or more clamping members include at least one clamping polycrystalline diamond element having a generally rounded or semispherical surface and at least one clamping polycrystalline diamond element having a generally flat or planar surface.

5. The cutting tool assembly of claim 4, wherein each of the one or more clamping members includes an upper surface distal to the base body and one or more slanted surfaces, the at least one clamping polycrystalline diamond element having the generally rounded or semispherical surface secured to the clamping member being positioned on the one or more slanted surfaces of the clamping member and the at least one clamping polycrystalline diamond element having the generally flat or planar surface secured to the clamping member being positioned on the one or more slanted surfaces of the clamping member.

6. The cutting tool assembly of claim 4, wherein each of the one or more clamping members includes an upper surface distal to the base body and one or more slanted surfaces, the at least one clamping polycrystalline diamond element having the generally rounded or semispherical surface secured to the clamping member being positioned on the upper surface of the clamping member and the at least one clamping polycrystalline diamond element having the generally flat or planar surface secured to the clamping member being positioned on the one or more slanted surfaces of the clamping member.

7. The cutting tool assembly of claim 4, wherein each of the one or more clamping members includes an upper surface distal to the base body and one or more slanted surfaces, the at least one clamping polycrystalline diamond element having the generally rounded or semispherical surface secured to the clamping member being positioned on the one or more slanted surfaces of the clamping member and the at least one clamping polycrystalline diamond element having the generally flat or planar surface secured to the clamping member being positioned on the upper surface of the clamping member.

8. The cutting tool assembly of claim 1, wherein:

the base body includes one or more tool positioning features each of which includes at least a base body channel at least partially defined by two opposing channel sidewalls and a channel bottom;

the one or more cutting tools include a tool body including opposing sidewalls having angled upper portions that define an acute angle therebetween and a positioning feature adjacent to a corresponding one of the one or more tool positioning features, wherein the base body channel is sized and configured to accept at least a portion of the positioning feature of a respective cutting tool, and the positioning feature and the one or more tool positioning features are sized and configured to position and orient the tool body; and the one or more clamping members secure at least one of the one or more cutting tools to the base body and include opposing sidewalls defining an acute angle therebetween that is inverted compared to the acute angled defined by the upper portions of the opposing sidewalls of the tool body, wherein the tool body of at least one of the one or more cutting tools is positioned adjacent to the one or more clamping members.

9. A material removal system, comprising:

a movable and/or rotatable cutterhead; and one or more cutting tool assemblies mounting to the movable and/or rotatable cutterhead, each of the one or more cutting tool assemblies including:

a base body including a surface mountable to a cutterhead of a material removal machine;

one or more cutting tools secured to the base body, the one or more cutting tools including at least one polycrystalline diamond element having a generally rounded or semispherical surface and at least one polycrystalline diamond element having a generally flat surface; and one or more clamping members secured to the base body, each of the one or more clamping members including a plurality of polycrystalline diamond elements secured thereto.

10. The material removal system of claim 9, wherein each of the one or more cutting tools includes an upper surface distal to the base body and one or more slanted surfaces, the at least one polycrystalline diamond element having the generally rounded or semispherical surface being positioned on the upper surface and the at least one polycrystalline diamond element having the generally flat surface being positioned on the one or more slanted surfaces.

11. The material removal system of claim 10, wherein each of the one or more cutting tools includes one or more additional polycrystalline diamond elements secured to the one or more slanted surfaces.

12. The material removal system of claim 9, wherein the plurality of polycrystalline diamond elements secured to each clamping member of the one or more clamping members include at least one polycrystalline diamond element having a generally rounded or semispherical surface secured to the clamping member and at least one polycrystalline diamond element having a generally flat or planar surface secured to the clamping member.

13. The material removal system of claim 12, wherein each of the one or more clamping members includes an upper surface distal to the base body and one or more slanted surfaces, the at least one polycrystalline diamond element having the generally rounded or semispherical surface secured to the clamping member being positioned on the one or more slanted surfaces of the clamping member and the at least one polycrystalline diamond element having the generally flat or planar surface secured to the clamping member being positioned on the one or more slanted surfaces of the clamping member.

14. The material removal system of claim 12, wherein each of the one or more clamping members includes an upper surface distal to the base body and one or more slanted surfaces, the at least one polycrystalline diamond element having the generally rounded or semispherical surface secured to the clamping member being positioned on the upper surface of the clamping member and the at least one polycrystalline diamond element having the generally flat or planar surface secured to the clamping member being positioned on the one or more slanted surfaces of the clamping member.

15. The material removal system of claim 12, wherein each of the one or more clamping members includes an upper surface distal to the base body and one or more slanted surfaces, the at least one polycrystalline diamond element having the generally rounded or semispherical surface secured to the clamping member being positioned on the one or more slanted surface of the clamping member and the at least one polycrystalline diamond element having the generally flat or planar surface secured to the clamping member being positioned on the upper surface of the clamping member.

16. A cutting tool assembly, comprising:

a base body including a surface mountable to a cutterhead of a material-removal machine;

a plurality of cutting elements;

one or more cutting tools secured to the base body and having one or more cutting elements of the plurality of cutting element secured thereto; and one or more clamping members secured to the base body and having one or more cutting elements of the plurality of cutting elements secured thereto;

wherein at least one cutting element of the plurality of cutting elements defines a generally rounded or semispherical working surface is secured to at least one of the one or more cutting tools or the one or more clamping members; and wherein at least one cutting element of the plurality of cutting elements defines a generally flat working surface is secured to at least one of the one or more cutting tools or the one or more clamping members.

17. The cutting tool assembly of claim 16, wherein:

the one or more cutting tools have at least one cutting element of the plurality of cutting elements defining a generally rounded or semispherical working surface and at least one cutting element of the plurality of cutting elements defining a generally planar or flat working surface secured thereto; and the one or more clamping members each have one or more additional cutting elements of the plurality of cutting elements defining a generally rounded or semispherical working surface secured thereto.

18. The cutting tool assembly of claim 17, wherein:

the one or more cutting tools and the one or more clamping members are positioned on the base body along a generally curved reference line;

the at least one cutting element defining the generally rounded or semispherical working surface secured to each of the one or more cutting tools is offset from the generally curved reference line;

the at least one cutting element defining the generally planar or flat working surface secured to each of the one or more cutting tools is aligned along the generally curved reference line; and the one or more additional cutting elements defining the generally rounded or semispherical working surface secured to each of the one or more clamping members includes a first cutting element defining the generally rounded or semispherical working surface aligned along the generally curved reference line and a second cutting element defining the generally rounded or semispherical working surface offset from the generally curved reference line.

* * * * *